US011253121B2

(12) United States Patent
Van Der Kooi et al.

(10) Patent No.: US 11,253,121 B2
(45) Date of Patent: Feb. 22, 2022

(54) FLOOR NOZZLE FOR VACUUM CLEANER

(71) Applicant: KONINKLIJKE PHILIPS N.V., Eindhoven (NL)

(72) Inventors: Johannes Tseard Van Der Kooi, Hurdegaryp (NL); Egbert Van De Veen, Ijsselmuiden (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 304 days.

(21) Appl. No.: 14/240,204

(22) PCT Filed: Sep. 27, 2012

(86) PCT No.: PCT/IB2012/055141
§ 371 (c)(1),
(2) Date: Feb. 21, 2014

(87) PCT Pub. No.: WO2013/050906
PCT Pub. Date: Apr. 11, 2013

(65) Prior Publication Data

US 2014/0215749 A1 Aug. 7, 2014

Related U.S. Application Data

(60) Provisional application No. 61/542,310, filed on Oct. 3, 2011.

(51) Int. Cl.
*A47L 9/04* (2006.01)
*A47L 9/06* (2006.01)

(52) U.S. Cl.
CPC ..... *A47L 9/0477* (2013.01); *A47L 9/0488* (2013.01); *A47L 9/066* (2013.01); *A47L 9/0666* (2013.01)

(58) Field of Classification Search
CPC ..... A47L 9/0666; A47L 9/066; A47L 9/0477; A47L 9/0488
See application file for complete search history.

(56) References Cited

U.S. PATENT DOCUMENTS 2,292,435 A * 8/1942 Crites ..... A47L 1/02 15/321
3,699,607 A * 10/1972 Putt ..... A47L 11/302 15/320

(Continued)

FOREIGN PATENT DOCUMENTS

CN 1706331 A 12/2005
EP 1713370 A1 10/2006

(Continued)

*Primary Examiner* — Michael D Jennings
(74) *Attorney, Agent, or Firm* — Schott, P.C.

(57) ABSTRACT

A cleaning device, for cleaning a surface, includes a nozzle arrangement. The nozzle arrangement includes a brush compartment surrounded by a brush. The brush includes brush elements including tip portions for contacting the surface to be cleaned and picking up dirt particles and/or liquid from the surface during rotation of the brush. The nozzle arrangement further includes a bouncing element with position adjusted relative to the surface and depending on a direction of movement of the cleaning device. The bouncing element is arranged in a first position and at a first distance d1 to the surface, when the cleaning device is moved in a forward direction and in a second position and at a second distance d2 to the surface, when the cleaning device is moved in an opposite backward direction, such that d2 is greater than d1.

18 Claims, 8 Drawing Sheets

(56) References Cited

U.S. PATENT DOCUMENTS

| | | | | | |
|---|---|---|---|---|---|
| 4,177,536 | A * | 12/1979 | Powers | A47L 5/30 | 15/182 |
| 4,864,682 | A * | 9/1989 | Bewley, Jr. | A47L 5/34 | 15/364 |
| 5,045,118 | A | 9/1991 | Mason et al. | | |
| 5,212,848 | A * | 5/1993 | Geyer | A47L 11/305 | 15/245 |
| 5,398,373 | A * | 3/1995 | Blase | A47L 7/0009 | 15/322 |
| 5,551,119 | A * | 9/1996 | Worwag | A47L 9/0411 | 15/319 |
| 5,609,431 | A * | 3/1997 | Carroll | A41D 19/01 | 401/200 |
| 5,669,098 | A * | 9/1997 | Tono | A47L 11/30 | 15/321 |
| 5,715,565 | A | 2/1998 | Kem | | |
| 5,722,109 | A * | 3/1998 | Delmas | A47L 9/281 | 15/319 |
| 6,099,661 | A | 8/2000 | Conrad | | |
| 6,212,732 | B1 | 4/2001 | Tajima | | |
| 6,550,092 | B1 * | 4/2003 | Brown | A47L 13/16 | 15/104.002 |
| 7,013,521 | B2 * | 3/2006 | Grey | A46B 13/001 | 15/377 |
| 7,150,068 | B1 * | 12/2006 | Ragner | A47L 5/22 | 15/340.2 |
| 7,665,172 | B1 * | 2/2010 | Tran | A47L 11/24 | 15/41.1 |
| 2008/0276408 | A1 * | 11/2008 | Gilbert, Jr. | A47L 11/34 | 15/320 |
| 2008/0276414 | A1 * | 11/2008 | Wood | A46B 13/001 | 15/383 |
| 2011/0036373 | A1 * | 2/2011 | Hilton | A46B 9/02 | 134/6 |

FOREIGN PATENT DOCUMENTS

| | | | |
|---|---|---|---|
| EP | 2343003 | A1 | 7/2011 |
| JP | S60-100922 | A | 6/1985 |
| JP | 2001238831 | A | 9/2001 |
| JP | 2002028117 | A | 1/2002 |
| JP | 2002-345694 | A | 12/2002 |
| JP | 2003135326 | A | 5/2003 |
| JP | 2004-041454 | A | 2/2004 |
| JP | 2007000602 | A | 1/2007 |
| JP | 2007-521897 | A | 8/2007 |
| JP | 2008194329 | A | 8/2008 |
| JP | 2009-247597 | A | 10/2009 |
| JP | 2010-284526 | A | 12/2010 |
| JP | 2013-516263 | A | 5/2013 |
| WO | 2005074779 | A1 | 8/2005 |
| WO | 2010041185 | A1 | 4/2010 |
| WO | 20100041184 | A1 | 4/2010 |

* cited by examiner

FLOOR NOZZLE FOR VACUUM CLEANER

Cross-Reference to Prior Applications

This application is the U.S. National Phase application under 35 U.S.C. § 371 of International Application No. PCT/IB2012/055141, filed on Sep. 27, 2012, which claims the benefit of U.S. Provisional Patent Application No. 61/542,310, filed Oct. 3, 2011. These applications are hereby incorporated by reference herein.

FIELD OF THE INVENTION

The present invention relates to a cleaning device for cleaning a surface. Further, the present invention relates to a nozzle arrangement for such a cleaning device.

BACKGROUND OF THE INVENTION

Nowadays electrical floor cleaners can be distinguished into three groups. The first group of floor cleaners uses exclusively an airflow/under-pressure to ingest the dirt directly from the floor, e.g. from the carpet. A second group of floor cleaners makes use of a combination of air flow and a rotating brush. They mostly rely on hard brushes to disperse the dust. Due to the rotation of the brush, the dust will be made airborne from the floor and collected afterwards.

According to the prior art two different concepts are known for collecting the dispersed dust. The first known concept aims at collecting the dust in a so-called dust pan, which is positioned on the floor. Thereto, the dust pan is arranged on the side of the brush where the dust is released from the brush, i.e. on the side where the dust is dispersed. However, this concept has a major disadvantage, since dust and dirt can only enter the brush from one direction, i.e. from the opposite side of the dust pan. Thus, these devices always have to be moved in a forward direction in which the brush is, seen in the direction of the device movement, located in front of the dust pan. Moving the device in an opposite backward direction would not result in a dirt and dust pick-up, since the dirt and dust would not reach the brush from this side. This again results in a non-satisfying, limited work capability.

The second concept known from the prior art for collecting dirt that is dispersed by a rotating brush is to use an external vacuum source. These products use the brush to disperse the dust in combination with an air flow created by the vacuum aggregate to lift the dispersed dust. Such a kind of device is exemplarily known from WO 2005/074779 A1. This device includes a vacuum aggregate to create an under-pressure within a suction chamber that is delimited at its front and rear side by delimiting elements, such as runners. The rotary brush is arranged inside the suction chamber. The brush is used to sweep the floor and disperse the dust, which is then ingested by the vacuum flow source. The two delimiting elements that are proposed according to this solution are designed to be vertically mobile, so that they can be lifted depending on a forward or backward movement of the nozzle. These delimiting elements have the function to stabilize the under-pressure within the suction chamber in order to receive a constant suction flow (a constant under-pressure) within the suction chamber independent of the movement direction of the nozzle.

However, the device proposed in WO 2005/074779 A1 includes several disadvantages. First of all, the construction including the two delimiting elements is rather complicated and interference-prone. Secondly, the brush which is used in this vacuum cleaner is an agitator (also denoted as adjutator) with stiff brush hairs to agitate the floor. However, an assembly including such an agitator requires a high suction power in order to receive a satisfactory cleaning result especially on hard floors. Therefore, large vacuum aggregates need to be used which again results in a high consumer price of the device.

A third group of nowadays electrical floor cleaners makes use of two separate brushes that are arranged in parallel to each other. These brushes rotate at high speeds, one running clockwise and the other one counterclockwise. However, in order to ingest the dirt that is lifted by the brushes, most of the devices need an external flow source, which again makes the device cost intensive. Besides that, using two separate brushes makes the nozzle fairly bulky, which ends up in a non-satisfying liberty of action for the consumer.

SUMMARY OF THE INVENTION

It is an object of the present invention to provide an improved cleaning device that shows, compared to the state of the art, an improved cleaning performance, has at the same time a nozzle of small size, is easy to use, and less cost intensive for the user. It is especially an object to provide a cleaning device that shows an improved cleaning performance without the need of an external vacuum source, so that costs for the vacuum source can be saved without limiting the cleaning performance.

This object is achieved by a cleaning device for cleaning a surface, with a nozzle arrangement comprising:

a brush rotatable about a brush axis, said brush being provided with brush elements having tip portions for contacting the surface to be cleaned and picking up dirt particles and/or liquid from the surface during the rotation of the brush, a drive means for driving the brush in rotation, a bouncing element comprising a bouncing surface that is configured to let the dirt particles and/or liquid, that are released from the brush during rotation, rebound to the brush, said bouncing surface being spaced apart from the brush and extending substantially parallel to the brush axis, and an adjustment means for adjusting the position of the bouncing element relative to the surface depending on a direction of movement of the device, wherein the adjustment means is adapted to arrange the bouncing element in a first position in which the bouncing element has a first distance d1 to the surface, when the cleaning device is moved in a forward direction, in which the bouncing element is, seen in the direction of movement of the device, located behind the brush, and to arrange the bouncing element in a second position in which the bouncing element has a second distance d2 to the surface, when the cleaning device is moved in an opposite backward direction, wherein d2 is greater than d1 and equal to d3*tan($\alpha$), d3 being the distance between the bouncer and the position of the brush where the tip portions lose contact from the surface during the rotation of the brush, and $\alpha$ being an angle that is equal to or smaller than 20°.

The above-mentioned object is furthermore, according to a second aspect of the present invention, achieved by a corresponding nozzle arrangement for use in a cleaning device as mentioned before.

Preferred embodiments of the invention are defined in the dependent claims. It shall be understood that the claimed nozzle arrangement has similar and/or identical preferred embodiments as the claimed cleaning device and as defined in the dependent claims.

The present invention is based on the idea that a bouncing element is provided. This bouncing element may be an elastic element that is, for example, made of rubber or plastic. This bouncing element comprises a bouncing surface at which the dirt and/or liquid particles, that are picked up by the brush and released from the brush during its rotation, may rebound back to the brush and made airborne again by the rotating brush. In this way, the dirt and/or liquid particles are picked up by the brush, bounce forth and back between the brush and the bouncing element/bouncing surface in a zig-zag-like manner, and are lifted from the floor in this way without the need of an external vacuum source.

In contrast to the prior art devices, the above-described adjustment of the bouncing element, which depends on the movement direction of the nozzle, allows a very good dirt pick-up in the forward stroke as well as in the backward stroke, without the need of an additional vacuum source.

The inventors have found that the picked up dirt and liquid is released from the brush in a certain angle having a certain velocity, as soon as the tip portions of the brush lose contact from the surface during the brush's rotation. It has been found by experiments that this release angle $\alpha$, with which the dirt and/or liquid is released from the brush with respect to the surface, depends on the rotational speed of the brush, on the size and properties of the dirt particles, and on the direction with which the dirt particles enter the rotating brush. In other words, the release angle does not only depend on the rotational speed of the brush and the properties of the dirt particles, but also on whether the dirt particles enter the brush in the direction of the brush's rotation or against the direction of the brush's rotation. This means that the dirt release angle $\alpha$ is different in a forward stroke of the nozzle than in a backward stroke of the nozzle.

Experiments have shown that, depending on the dirt properties (size and weight), the dirt particles leave the brush with an angle of around 0-25° relative to the floor when the dirt is entering the brush along with the rotation of the brush. In contrast thereto, the release angle $\alpha$ has found to be in a range of around 10-60° when the dirt particles enter the brush against the brush's rotation. This means that the situation is different in a forward stroke of the nozzle than in a backward stroke.

To account for this effect an adjustment means is provided for adjusting the position of the bouncing element relative to the surface depending on the movement direction of the device. The adjustment means is adapted to arrange the bouncing element in a first position in which the bouncing element has a first distance d1 to the surface, when the cleaning device is moved in a forward direction, in which the bouncing element is, seen in the direction of movement of the device, located behind the brush. The distance d1 therein denotes a vertical distance between the lower surface of the bouncing element and the surface to be cleaned (the floor).

The bouncing element is, according to the present invention, arranged on the side of the brush, where the dirt and/or liquid particles are released from the brush. This ensures that the released dirt and/or liquid particles in any case bounce against the bouncing element after being released from the brush. In other words, this means that in the above described forward stroke of the device (forward direction), the dirt is encountered by the brush along with the brush's rotation. Thus, the distance d1 between the bouncing element and the surface needs to be rather small, since the dirt is released rather flat ($\alpha$ being around) 0-25°.

On the other hand, the bouncing element is in its second position arranged in a distance d2 to the surface, when the cleaning device is moved in the opposite backward direction, in which the bouncing element is, seen in the direction of movement of the device, located in front of the brush. The distance d2 needs to be large enough to let dirt and/or liquid particles enter the nozzle in order to be encountered by the brush. In other words, a gap needs to be formed between the lower surface of the bouncing element and the surface that is large enough for dirt and/or liquid particles to enter the nozzle. On the other hand, the vertical height of this gap (meaning the height perpendicular to the surface to be cleaned) may not be too large, since the dirt particles that are released from the brush during its rotation would then be thrown out of the nozzle, i.e. leave the nozzle through the gap between the bouncing element and the floor.

Therefore, d2 (backward stroke) needs to be larger than d1 (forward stroke), but small enough to guarantee that the released dirt particles hit the bouncer to establish the above-described bouncing effect, i.e. that the dirt particles bounce forth and back between the bouncing element and the brush and are lifted from the floor in this way.

Since the above-described experiments have shown that the release angle $\alpha$ is in a range of 10-60° when the dirt and/or liquid particles enter the brush against its rotation in the backward stroke, it has been found to be a good trade-off to arrange the bouncing element in this situation with a distance d2 to the surface, wherein $d2 = d3 * \tan(\alpha)$, with $\alpha$ having a maximum value of 20°. Therein, d3 denotes the distance between the bouncing element and the position of the brush where the tip portions lose contact from the surface during the brush's rotation. In other words, distance d3 is the distance measured parallel to the surface to be cleaned from the point, where the dirt and/or liquid particles are released from the brush to the first point at which they bounce against the bouncing surface.

It has to be noted that the value of 20° for $\alpha$ is not a randomly chosen value. A maximum value of 20° for $\alpha$ has been derived from the above-mentioned experimental results. It has been shown that the dirt particles are released from the brush in a kind of uniform distribution within the above-mentioned angle range. This means that in a backward stroke, where the dirt particles encounter the brush against the rotation direction, the amount of dirt particles that are released in a certain angle is uniformly distributed over the above-mentioned angle range of 10-60°, meaning that approximately the same amount of dirt leaves the brush with an angle of 60° relative to the surface as the amount that leaves the brush with an angle of 10° with respect to the surface.

A maximum angle $\alpha = 20°$ thus results in a so-called dust pick-up ratio (dpu) of around 80%, meaning that the surface is freed from approximately 80% of the dirt that is located thereon. Of course, smaller values for $\alpha$ result in an even higher dpu. However, a value of 80% dpu is already higher than traditional vacuum cleaners, such as e.g. the vacuum cleaners that have been described in the opening paragraphs of the background of the invention, which enable a dpu of 75%. Bearing in mind that these traditional vacuum cleaners have to use an external vacuum source, whereas the device according to the present invention has a dpu of 80% without the need of a vacuum source (only making use of the above-mentioned bouncing effect between the brush and the bouncing element), this is a surprisingly good result.

Decreasing the maximum value for α increases the above-mentioned dpu ratio, since according to the given geometrical relationship this also decreases d2 (the gap between the bouncing element and the surface, or in other words, the exit gap for the dirt particles to leave the nozzle housing again). Decreasing the maximum value for α thus also decreases the probability that dirt particles, which have been picked up by the brush, leave the nozzle housing again and do not hit the bouncing element in order to be lifted in the above-mentioned way.

According to an embodiment of the present invention, α is equal to or smaller than 15°, preferably equal to or smaller than 12°, more preferably in a range of 9° to 11°, and most preferably equal to 10°.

Assuming the above-mentioned uniform distribution of the dirt release, an angle of α=15° results in a dpu ratio of 90%. An angle of α=12° even results in a dpu ratio of around 96%. An angle of around 10° has proven to result in an almost complete removal of dust and dirt from the surface (a dpu ratio of around 100%).

The angle of 10° results from experiments, where rice has been used as test dirt. Rice especially has difficult material properties that make a removal with a brush fairly complicated. However, it has been shown that also rice leaves the brush at a minimum angle of around 10° when entering the brush against its rotation in the backward stroke of the device. The experiments have also shown that this minimum release angle does not vary too much with the rotational speed of the brush. During the experiments the minimum release angle stayed almost constant when the rotational speed of the brush was varied between 4,000 and 8,000 rpm and above. Thus, optimal cleaning results enabling a dpu of around 100% may be achieved when choosing α to be more or less equal to 10°.

In other words, optimal cleaning results have been received when the bouncing element has been positioned at a distance d2 to the surface, wherein d2 is chosen to be around tan (10°)*d3. This value refers to the backward stroke, whereas the distance d1 of the bouncing element to the surface is preferably smaller in the forward stroke, since the dirt particles leave the brush in a smaller angle when entering the brush along with its rotation.

It is to be noted, that the terms forward and backward stroke or forward and backward movement are only definitions that are used herein to ease the understanding. However, these two definitions can be interchanged without leaving the scope of the invention, as long as the relationship between the brush and the bouncing element and their position to each other remain as defined above. In any case, independent of the forward and backward stroke, the bouncing element always needs to be arranged on the side of the brush where the dirt and/or liquid particles leave the brush.

According to an embodiment of the present invention, the adjustment means is adapted to arrange the bouncing element in the first position in a distance d1 of zero, wherein the bouncing element touches the surface. Arranging the bouncing element so that it touches the surface (distance d1=0) enables the best possible cleaning result also in the forward stroke, in which the bouncing element is, seen in the direction of movement of the device, located behind the brush.

Since in this situation the dirt has been found to be released from the brush within an angle range of 0° to 25° relative to the floor, it is ensured that all dirt particles, also the dirt particles which are launched parallel to the floor, hit the bouncing element, rebound to the brush, are airborne again when encountering the brush elements again, and are lifted in the way explained above by bouncing forth and back in a zig-zag-like manner between the brush and the bouncing surface.

In case the distance d1 is chosen to be zero, the bouncing element may act as squeegee. The bouncing element may, for example, be realized by a flexible rubber lip that is attached to the bottom of the nozzle housing of the cleaning device. This flexible rubber lip is adapted to flex about its longitudinal direction, depending on the movement direction of the cleaning device.

According to this embodiment, said rubber lip preferably comprises at least one or a plurality of studs, which are arranged near the lower end of the rubber lip, where the rubber lip is intended to touch the surface to be cleaned. In this embodiment the studs may be regarded as adjusting means for adjusting the position of the bouncing element. Said at least one stud is being adapted to at least partly lift the rubber lip from the surface, when the cleaning device is moved on the surface in the above-described backward direction, in which the rubber lip is, seen in the direction of movement of the cleaning device, located in front of the brush. In this case the rubber lip is lifted, which is mainly due to natural friction which occurs between the surface and the studs, which act a kind of stopper that decelerates the rubber lip and forces it to flip over the studs. The squeegee is thus forced to glide on the studs, wherein the rubber lip is lifted by the studs and a gap occurs in the space between the rubber lip and the surface. The above-mentioned distance d2 between the bouncing element/rubber lip and the surface may be realized by adapting the size of the studs, so that the studs lift the rubber lip accordingly to a distance d2 from the surface. In this case, the above-mentioned geometrical relationship (d2=d3*tan(α)) is also guaranteed.

When using the above-described rubber lip as the bouncing element, said studs are free from contact to the floor, when the cleaning device is moved on the surface in the opposite forward direction. The rubber lip may thus freely glide over the floor and thereby wipes and collects dirt and/or liquid particles from said floor.

As explained above, the occurring accelerations at the tip portions of the brush elements cause the dirt particles to be automatically released from the brush, when the brush elements lose contact from the floor during their rotation. Since not all dirt particles and liquid droplets may be directly lifted in the above-manner (bouncing zig-zag-wise between the brush and the bouncing element), a small amount of dirt particles and/or liquid droplets will be flung back onto the surface in the area where the brush elements lose the contact from the surface. This effect of re-spraying the surface is overcome by the bouncing element that acts as a squeegee and collects the re-sprayed dirt and/or liquid by acting as a kind of wiper.

According to a further preferred embodiment of the present invention, the adjustment means is adapted to arrange the bouncing element in the second position with a second distance d2 to the surface, wherein d2 is in a range of 0.3 to 7 mm, preferably in a range of 0.5 to 5 mm, and most preferably in a range of 1 to 3 mm. This situation again refers to the above-mentioned backward stroke, in which the bouncing element is, seen in the direction of movement of the device, located in front of the brush.

In this case, the gap between the bouncing element and the surface to be cleaned (d2) needs to be large enough to enable most of the dirt particles, preferably all dirt particles to enter the nozzle arrangement and encounter the brush. It is to be noted that the named distance ranges are also not randomly chosen, but result from experiments of the applicant.

First of all, it has been shown that by creating a gap of 7 mm, even the largest common dirt particles may enter the nozzle arrangement. On the other hand, as it can be seen from the above-mentioned geometrical relationship between d3 and d2 (d2=d3*tan(α)), increasing the bouncer-to-surface distance d2 also increases the bouncer-to-brush distance d3 when assuming that the release angle α is kept constant. However, the distance d3 between the brush and the bouncing element should not be too large, since this distance is limited by the kinetic energy of the dirt particles. Travelling from the brush to the bouncing element, the kinetic energy of the dirt particles will be lost by the air resistance of the dirt particles. Since there should be enough energy left to bounce back from the bouncing surface into the brush, d3 should not exceed a value of around 3 to 4 cm. Taking into account this limitation for d3, a limitation for d2 results in the above-mentioned distance ranges.

A bouncer-to-surface distance d2 of around 1 to 3 mm has shown to be the best possible trade-off, wherein still most of the dirt particles may enter the nozzle and the bouncer-to-brush distance d3 is small enough to establish the above-mentioned bouncing effect, and thus to realize a very good cleaning result.

In order to further improve the cleaning result, the bouncing surface of the bouncing element is, according to a further embodiment of the present invention, tilted with respect to a vertical axis that is perpendicular to the surface. In other words, the bouncing surface is inclined with respect to the vertical axis. Having this inclination the bouncing surface is no longer arranged perpendicular to the surface to be cleaned (the floor), but faces upwards, away from the floor. This allows an easier lift-up of the dirt particles that bounce against the bouncing surface, since due to the inclination of the bouncing surface the dirt particles are automatically reflected in an upward direction. Especially in case the dirt particles are released from the brush with a release angle of 0° (parallel to the floor) the dirt particles will bounce back from the bouncing surface in the inclination angle, thereby being lifted faster.

According to a further embodiment, the nozzle arrangement comprises a nozzle housing that at least partly surrounds the brush, and wherein the bouncing element is attached to said housing. In this arrangement the brush is at least partly surrounded by the nozzle housing and protrudes at least partly from a bottom side of said nozzle housing, which, during use of the device, faces the surface to be cleaned, so that the brush elements contact said surface outside of the housing during the rotation of the brush.

The bouncing element is preferably also attached to said bottom side of the housing in order to contact the surface to be cleaned (d1=0), when the nozzle is moved over said surface in the forward direction.

According to a further preferred embodiment of the present invention, the linear mass density of a plurality of the brush elements is, at least at the tip portions, lower than 150 g/10 km, preferably lower than 20 g/10 km. In contrast to brushes used according to the prior art, which are only used for stain removal (so-called adjutators), a soft brush with flexible brush elements as presented here also has the ability to pick-up water from the floor. Due to the flexible micro-fiber hairs that are preferably used as brush elements, dirt particles and liquid can be picked up from the floor when the brush elements/micro-fiber hairs contact the floor during the rotation of the brush. The ability to also pick-up water with a brush is mainly caused by capillary and/or other adhesive forces that occur due to the chosen linear mass density of the brush elements. The very thin micro-fiber hairs furthermore make the brush open for coarse dirt.

It is to be noted that the linear mass density as mentioned, i.e. the linear mass density in gram per 10 km, is also denoted as Dtex value. A very low Dtex value of the above-mentioned kind ensures that, at least at the tip portions, the brush elements are flexible enough to undergo a bending effect and are able to pick-up dirt particles and liquid droplets from the surface to be cleaned. Furthermore, the extend of wear and tear of the brush elements appears to be acceptable within this linear mass density range.

The experiments carried out by the applicant have proven that a Dtex value in the above-mentioned range appears to be technically possible and that good cleaning results can be obtained therewith. However, it has shown that cleaning results can be further improved by applying brush elements with an even lower upper limit of the Dtex value, such as a Dtex value of 125, 50, 20 or even 5 (in g/10 km).

According to a further preferred embodiment of the present invention, the drive means are adapted to realize a centrifugal acceleration at the tip portions of the brush elements which is, in particular during a dirt release period when the brush elements are free from contact to the surface during rotation of the brush, at least 3,000 $m/s^2$, more preferably at least 7,000 $m/s^2$, and most preferably 12,000 $m/s^2$.

It is to be noted that the minimum value of 3,000 $m/s^2$ in respect of the acceleration which is prevailing at the tip portions at least during a dirt release period when the brush elements are free from contact to the surface during the rotation of the brush, is also supported by results of experiments which have been performed in the context of the present invention. These experiments have shown that the cleaning performance of the device according to the present invention improves with an increase of the angular velocity of the brush, which implies an increase of the acceleration at the tip portions of the brush elements during rotation.

When the drive means are adapted to realize centrifugal accelerations of the brush elements in the above-mentioned ranges, it is likely for the liquid droplets adhering to the brush elements to be expelled as a mist of droplets during a phase in which the brush elements are free from contact to the surface to be cleaned.

Combining the above-mentioned parameters for the linear mass density of the flexible brush elements with the parameters for the acceleration of the tips of the brush elements yields optimal cleaning performance of the rotatable brush, wherein practically all dirt particles and spilled liquid encountered by the brush are picked up by the brush elements and expelled at a position inside the nozzle housing. As explained above, the expelled dirt and/or liquid particles are thrown against the bouncing element, rebound back from the bouncing surface to the brush, and are lifted in the above-mentioned zig-zag bouncing manner.

A good combination of the linear mass density and the centrifugal acceleration at the tip portions of the brush elements is providing an upper limit for the Dtex value of 150 g/10 km and a lower limit for the centrifugal acceleration of 3,000 $m/s^2$. This parameter combination has shown to enable for excellent cleaning results, wherein the surface is practically freed of particles and dried in one go. Using this parameter combination has also shown to result in very good stain removing properties. The ability to also pick-up liquid/water with a brush is mainly caused by capillary and/or other adhesive forces that occur due to the chosen linear mass density of the brush elements and the occurring high speeds with which the brush is driven.

The combination of the above-mentioned parameters concerning the linear mass density and the realized centrifugal acceleration at the tip portions of the brush elements is not found on the basis of knowledge of the prior art. The prior art is not even concerned with the possibility of having an autonomous, optimal functioning of only one rotatable brush which is used for cleaning a surface and is also able to lift dirt and liquid.

In order to realize the above-mentioned centrifugal accelerations at the tip portions of the brush elements, the drive means are, according to an embodiment of the present invention, adapted to realize an angular velocity of the brush which is in a range of 3,000 to 15,000 revolutions per minute, more preferably in a range of 5,000 to 8,000 revolutions per minute, during operation of the device. Experiments of the applicant have shown that optimal cleaning results can be obtained, when the brush is driven at an angular velocity which is at least 6,000 revolutions per minute.

However, the desired accelerations at the tip portions of the brush elements do not only depend on the angular velocity, but also on the radius, respectively on the diameter of the brush. It is therefore, according to a further embodiment of the invention, preferred that the brush has a diameter which is in a range of 10 to 100 mm, more preferably in a range of 20 to 80 mm, and most preferably in a range of 35 to 50 mm, when the brush elements are in a fully outstretched condition. The length of the brush elements is preferably in a range of 1 to 20 mm, more preferably in a range of 8 to 12 mm, when the brush elements are in a fully outstretched condition.

According to a further embodiment, the cleaning device further comprises a vacuum aggregate for generating an under-pressure in a suction area that is defined in a space between the brush and the bouncing element for ingesting dirt particles and liquid, wherein said under-pressure generated by the vacuum aggregate is in a range of 3 to 70 mbar, preferably in a range of 4 to 50 mbar, most preferably in a range of 5 to 30 mbar.

Even though a vacuum aggregate is, as mentioned above, not necessarily needed according to the present invention, an additional vacuum aggregate may further increase the cleaning performance. Especially the so-called effect of re-spraying the surface may be improved or overcome by providing this vacuum aggregate. This shall be explained in the following.

The occurring accelerations at the tip portions of the brush elements cause the dirt particles and liquid droplets to be automatically released from the brush, when the brush elements lose contact from the floor during their rotation. Since not all dirt particles and liquid droplets may be thrown to the bouncing element in a sufficiently large release angle in order to be lifted in the above-mentioned bouncing manner, a small amount of dirt particles and liquid droplets will be flung back onto the surface in the area where the brush elements lose the contact from the surface. However, this effect of re-spraying the surface is overcome by the bouncing element and the vacuum aggregate. The bouncing element collects the re-sprayed liquid and dirt by acting as a kind of wiper, so that remaining liquid and dirt may then be ingested due to the applied under-pressure that is generated by the additional vacuum aggregate. The bouncing element acting as a squeegee therefore ensures that the remaining liquid and dirt is not leaving the suction area between the bouncing element and the brush without being ingested by the vacuum aggregate. This effect mainly occurs when the device is moved in the forward direction, in which the bouncing element preferably glides over the surface.

In contrast to the above-mentioned pressure ranges that are generated by the additional vacuum aggregate, state of the art vacuum cleaners need to apply higher under-pressures in order to receive acceptable cleaning results. However, due to the above-mentioned bouncing effect that is used according to the present invention and due to the above-mentioned properties of the brush, very good cleaning results may already be realized in the above-mentioned pressure ranges. Thus, also smaller vacuum aggregates may be used. This increases the freedom in the selection of the vacuum pump. Again, it is to be noted that a vacuum pump is not even needed in order to receive better cleaning results as prior art cleaning devices.

The presented cleaning device may further comprise positioning means for positioning the brush axis at a distance to the surface to be cleaned that is smaller than the radius of the brush with fully outstretched brush elements, to realize an indentation of the brush part contacting the surface during operation, which indentation is in a range from 2% to 12% of the brush diameter.

As a result, the brush elements are bent when the brush is in contact with the surface. Hence, as soon as the brush elements come into contact with a surface during rotation of the brush, the appearance of the brush elements changes from an outstretched appearance to a bent appearance, and as soon as the brush elements lose contact with the surface during rotation of the brush, the appearance of the brush elements changes from a bent appearance to an outstretched appearance.

A practical range for an indentation of the brush is arranged from 2% to 12% of a diameter of the brush relating to a fully outstretched condition of the brush elements. In practical situations, the diameter of the brush as mentioned can be determined by performing an appropriate measurement, for example, by using a high-speed camera or a stroboscope which is operated at the frequency of a rotation of the brush.

A deformation of the brush elements, or, to say it more accurately, a speed at which deformation can take place, is also influenced by the linear mass density of the brush elements. Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to be cleaned is relatively low. This also means that a friction power which is generated between the brush elements and the surface is low, whereby heating of the surface and associated damage of the surface are prevented. Other advantageous effects of a relatively low linear mass density of the brush elements are a relatively high resistance to wear, a relatively small chance of damage by sharp objects or the like, and the capability to follow the surface in such a way that contact is maintained even when a substantial unevenness in the surface is encountered.

When brush elements come into contact with a dirt particle or liquid, or, in case an indentation of the brush with respect to the surface is set, the brush elements are bent. As soon as the brush elements with the dirt particles and liquid adhering thereto lose contact with the surface, the brush elements are straightened out, wherein especially the tip portions of the brush elements are moved with a relatively high acceleration. As a result the centrifugal acceleration at the top portions of the brush elements is increased. Hence, the liquid droplets and dirt particles adhering to the brush elements are launched from the brush elements, as it were, as the acceleration forces are higher than the adhesive forces, as this has been mentioned according to the embodiment above. The values of the acceleration forces are determined by various factors, including the deformation and the linear mass density as mentioned, but also by the speed at which the brush is driven.

A factor which may play an additional role in the cleaning function of the rotatable brush is a packing density of the brush elements. When the packing density is large enough, capillary effects may occur between the brush elements, which enhance fast removal of liquid from the surface to be cleaned. According to an embodiment of the present invention the packing density of the brush elements is at least 30 tufts of brush elements per $cm^2$, wherein a number of brush elements per tuft is at least 500.

Arranging the brush elements in tufts forms additional capillary channels, thereby increasing the capillary forces of the brush for picking-up dirt particles and liquid droplets from the surface to be cleaned.

As it has been mentioned above, the presented cleaning device has the ability to realize extremely good cleaning results. These cleaning results can be even improved by actively wetting the surface to be cleaned. This is especially advantageous in case of stain removal. The liquid used in the process of enhancing adherence of dirt particles to the brush elements may be provided in various ways. In a first place, the rotatable brush and the flexible brush elements may be wetted by a liquid which is present on the surface to be cleaned. An example of such a liquid is water, or a mixture of water and soap. Alternatively, a liquid may be provided to the flexible brush elements by actively supplying the cleansing liquid to the brush, for example, by oozing the liquid onto the brush, or by injecting the liquid into a hollow core element of the brush.

According to an embodiment, it is therefore preferred that the cleaning device comprises means for supplying a liquid to the brush at a rate which is lower than 6 ml per minute per cm of a width of the brush in which the brush axis is extending. It appears that it is not necessary for the supply of liquid to take place at a higher rate, and that the above-mentioned rate suffices for the liquid to fulfill a function as a carrying/transporting means for dirt particles. Thus, the ability of removing stains from the surface to be cleaned can be significantly improved. An advantage of only using a little liquid is that it is possible to treat delicate surfaces, even surfaces which are indicated as being sensitive to a liquid such as water. Furthermore, at a given size of a reservoir containing the liquid to be supplied to the brush, an autonomy time is longer, i.e. it takes more time before the reservoir is empty and needs to be filled again.

It has to be noted that, instead of using an intentionally chosen and actively supplied liquid, it is also possible to use a spilled liquid, i.e. a liquid which is to be removed from the surface to be cleaned. Examples are spilled coffee, milk, tea, or the like. This is possible in view of the fact that the brush elements, as mentioned before, are capable of removing the liquid from the surface to be cleaned, and that the liquid can be removed from the brush elements under the influence of centrifugal forces as described in the foregoing. The above-mentioned effect of re-spraying the surface in the area between the brush and the bouncing element may be overcome by the bouncing element which collects this re-sprayed liquid and dirt by acting as kind of wiper (in the forward stroke), so that remaining liquid and dirt may then be ingested if an under-pressure is applied using an additional vacuum aggregate. The combination of the selected brush with the bouncing element thus results in a very good cleaning and drying effect.

BRIEF DESCRIPTION OF THE DRAWINGS

These and other aspects of the invention will be apparent from and elucidated with reference to the embodiment(s) described hereinafter. In the following drawings

FIG. 9A schematically illustrates a dirt release from the brush according to the present invention in the second working position, while

FIG. 10A schematically illustrates a dirt release from the brush according to the present invention in the first working position, while

DETAILED DESCRIPTION OF EMBODIMENTS

Figure 1:
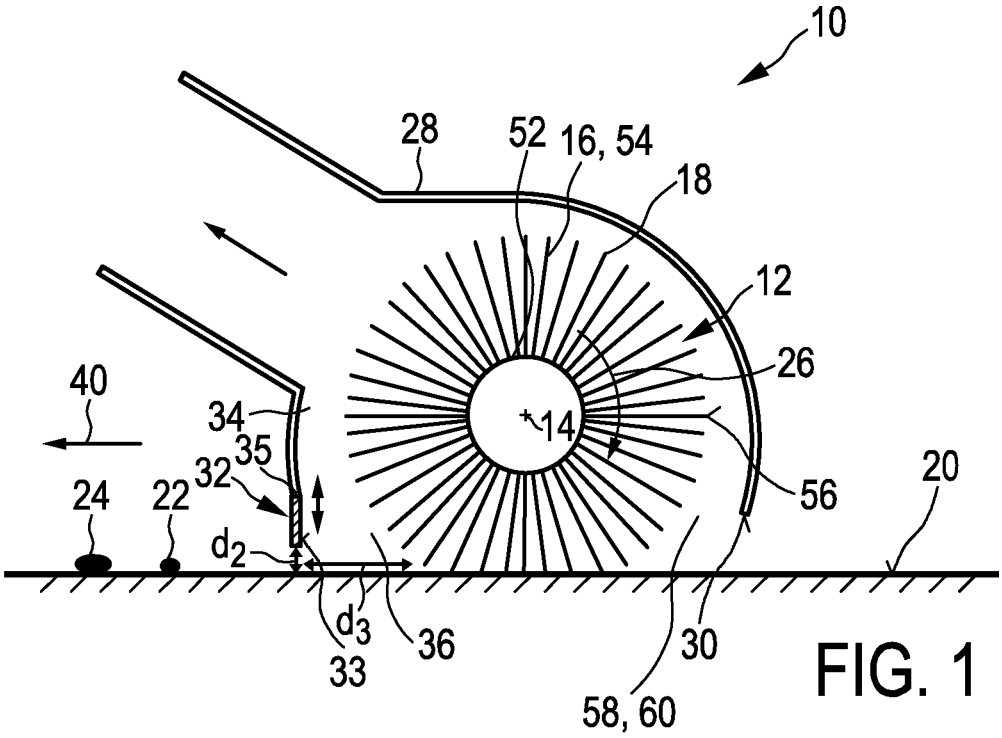
FIG. 1 shows a schematic cross-section of a first embodiment of a nozzle arrangement of a cleaning device according to the present invention, in a first working position.
Figure 2:
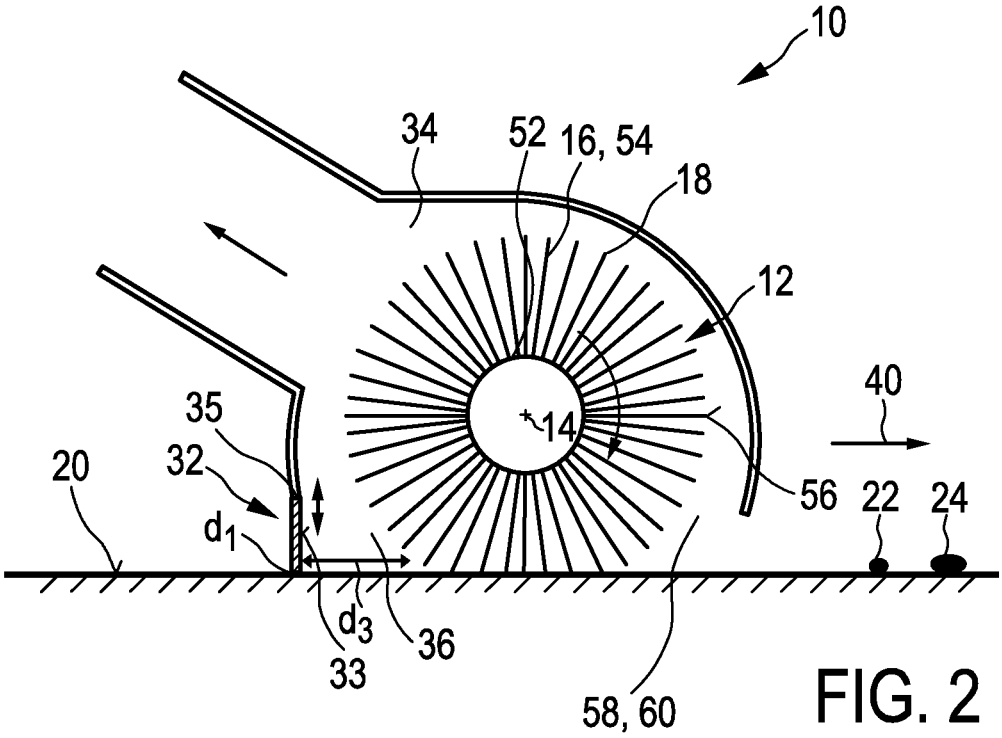
FIG. 2 shows a schematic cross-section of the first embodiment of the nozzle arrangement shown in FIG. 1 in a second working position.

FIGS. 1 and 2 show a schematic cross-section of a first embodiment of a nozzle arrangement 10 of a cleaning device 100 according to the present invention. In FIG. 1 the nozzle arrangement 10 is shown in a first working position, whereas in FIG. 2 the nozzle arrangement 10 is shown in a second working position. The nozzle arrangement 10 comprises a brush 12 that is rotatable about a brush axis 14. Said brush 12 is provided with flexible brush elements 16 which are preferably realized by thin microfiber hairs. The flexible brush elements 16 comprise tip portions 18 which are adapted to contact a surface to be cleaned 20 during the rotation of the brush 12 and to pick-up dirt particles 22 and/or liquid 24 from said surface 20 during a pick-up period when the brush elements 16 contact the surface 20.

A linear mass density of a majority of the brush elements 16 is, at least at their tip portions 18, preferably chosen to be lower than 150 g/10 km. Further, the nozzle arrangement 10 comprises a drive means, e.g. a motor (not shown), for driving the brush 12 in a predetermined direction of rotation 26. Said drive means are preferably adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

The brush 12 is at least partly surrounded by a nozzle housing 28. The arrangement of the brush 12 within the nozzle housing 28 is preferably chosen such that the brush 12 at least partially protrudes from a bottom side 30 of the nozzle housing 28, which, during use of the device 100, faces the surface to be cleaned 20.

Also attached to said bottom side 30 of the nozzle housing 28 is a bouncing element 32. Said bouncing element 32 is spaced apart from the brush 12 and extends substantially parallel to the brush axis 14. The nozzle housing 28, the bouncing element 32 and the brush 12 together define a suction area 34 which is located within the nozzle housing 28. It is to be noted that the suction area 34, in the meaning of the present invention, not only denotes the area between the brush 12, the bouncing element 32 and the nozzle housing 28, but also denotes the space between the brush elements 16 for the time during the rotation of the brush 12 in which the brush elements 16 are inside the nozzle housing, as well as it denotes an area that is defined between the bouncing element 32 and the brush 12. The latter area will be in the following also denoted as suction inlet 36 which opens into the suction area 34.

Further, it is to be noted that the term "suction area" is meant to denote an area in which the dirt and/or liquid particles 22, 24 are collected and picked up from the surface 20. It does not necessarily mean that a suction/under-pressure is created in this area 34,36.

Figure 6:
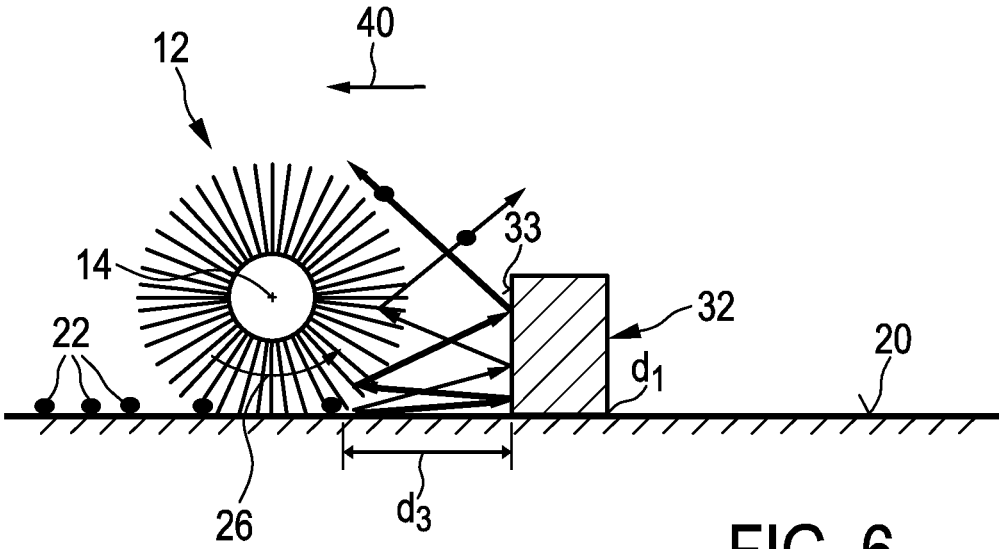
FIG. 6 illustrates the bouncing effect that is used according to the present invention to collect dirt and/or liquid, in the second working position.
Figure 7:
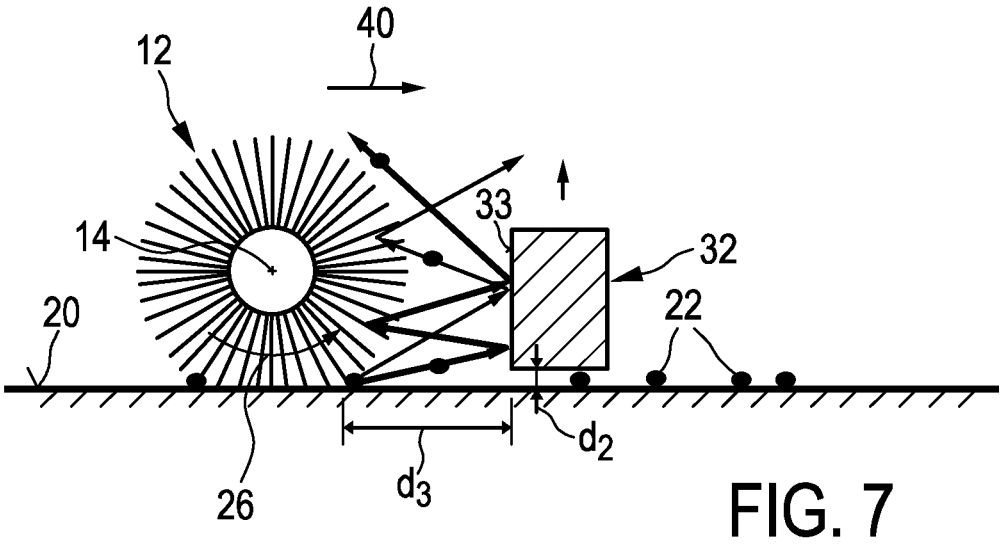
FIG. 7 illustrates the bouncing effect that is used according to the present invention to collect dirt and/or liquid, in the first working position.

The central working principle of the present invention is schematically illustrated in FIGS. 6 and 7. In these figures two positions of the bouncing element 32 are illustrated, which positions are changed depending on the movement direction 40 of the device 100. When the cleaning device 100 is moved in a forward direction (as shown in FIG. 6), in which the bouncing element 32 is, seen in the direction of movement 40, located behind the brush 12, the bouncing element has a distance d1 to the surface 20. The distance d1 is preferably chosen to be zero. In other words, the bouncing element 32 contacts the surface 20 in this situation. In contrast thereto, the bouncing element 32 has a distance d2 to the surface, when the cleaning device 100 is moved in the opposite backward direction (as shown in FIG. 7), in which the bouncing element is, seen in the direction of movement 40 of the device 100, located in front of the brush 12. The distance d2 needs to be large enough to let dirt 22 particles enter the nozzle 10 in order to be encountered by the brush 12.

It is to be noted that the situation shown in FIG. 6 corresponds to the situation shown in FIG. 2 (denoted as forward stroke), whereas the situation illustrated FIG. 7 corresponds to the situation shown in FIG. 1 (denoted as backward stroke). The only difference is that the positions of the bouncing element 32 and the brush 12 are mirror-inverted. However, the position of the bouncing element 32 and the brush 12 relative to each other remains the same. The bouncing element 32 is in each case arranged at the side of the brush 12, where the dirt and/or liquid particles 22, 24 leave the brush after having been encountered by the brush elements 16.

The bouncing element 32 comprises a bouncing surface 33 at which the dirt particles 22, that are picked up by the brush 12 and released from the brush 12 during its rotation, may rebound back to the brush 12 and made airborne again by the rotating brush 12. In this way, the dirt particles 22 are picked up by the brush 12, bounce forth and back between the brush 12 and the bouncing surface 33 in a zig-zag-like manner, and are lifted from the floor 20 in this way without the need of an external vacuum source.

The described zig-zag-like lifting manner results from the fact that the dirt particles 22 are reflected at the bouncing surface 33, wherein the angle of incidence is equal to the emergent angle at the bouncing surface 33, so that the dirt particles 22 automatically move relatively upwards when being rebound on the bouncing surface 33. Hitting again the brush elements 16 after being rebound from the bouncing surface 33 moves the dirt particles 22 further upwards due to the rotation of the brush 12 that is at this position directed upwardly. After hitting the bouncing surface 33 and the brush 12 a couple of times the dirt particles 22 are automatically lifted in an upward direction, away from the floor 20 without the need of an additional vacuum source. At any position within the nozzle 10 that is above the floor 20, a dust pan (not shown) can be arranged close to or at one side of the brush 12 to collect the lifted dust 22.

In order to receive a good gliding effect and produce only a small scratch load, the bouncing element 32 is preferably made of a flexible rubber.

Figure 9A:
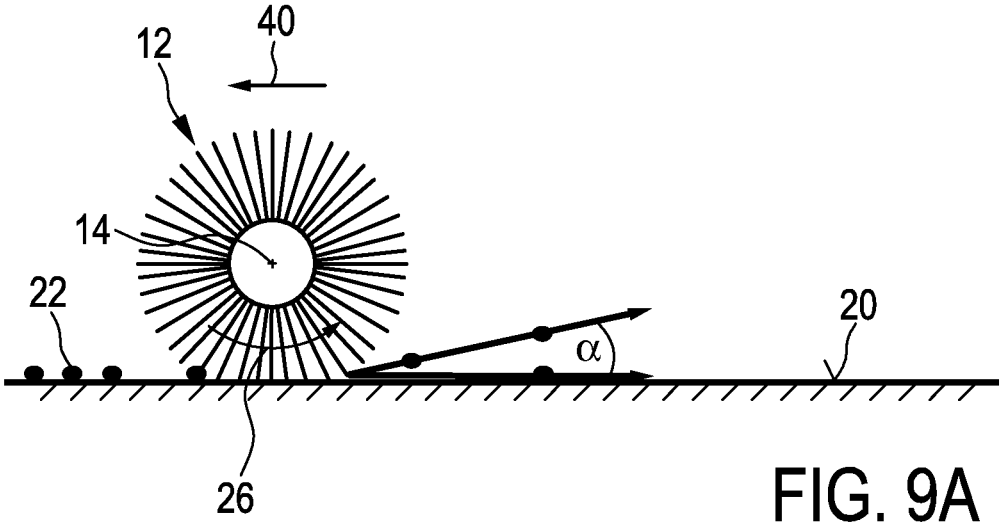
Figure 10A:
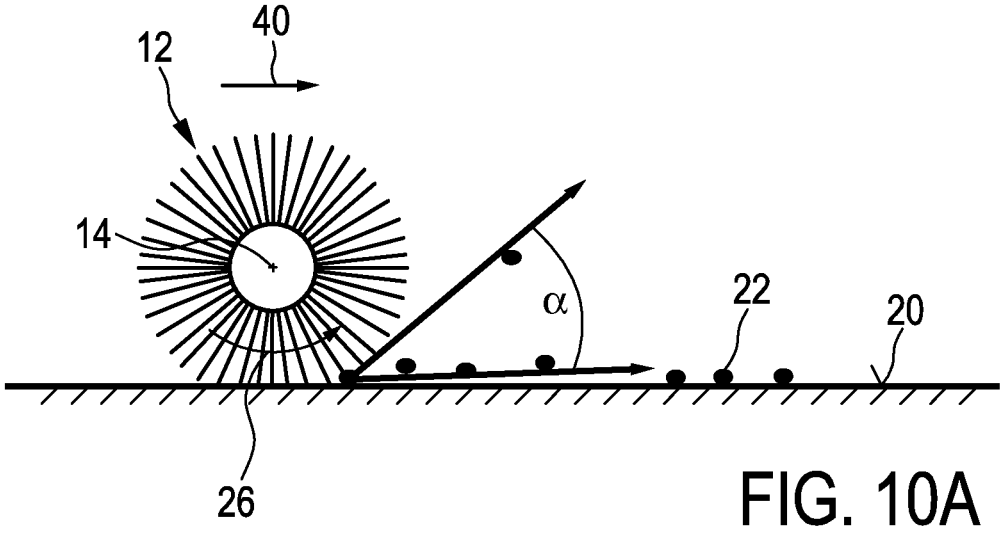

The reason why the bouncing element 32 is arranged at different positions depending on the movement direction 40 is that experiments have shown, that the release angle $\alpha$, with which the dirt particles 22 are released from the brush 12 with respect to the surface 20, does not only depend on the rotational speed of the brush 12 and on the properties of the dirt particles 22, but also on whether the dirt particles 22 enter the brush 12 along with the direction of the brush's rotation (as shown in FIG. 6) or against the direction of the brush's rotation (as shown in FIG. 7). This means that the dirt release angle $\alpha$ is different in a forward stroke of the nozzle 10 (FIGS. 2 and 6) than in a backward stroke of the nozzle 10 (FIGS. 1 and 7). This appearance can also be seen by comparing FIG. 9A, that shows the situation in the forward stroke, and FIG. 10A, which shows the same situation in the backward stroke.

Figure 9B:
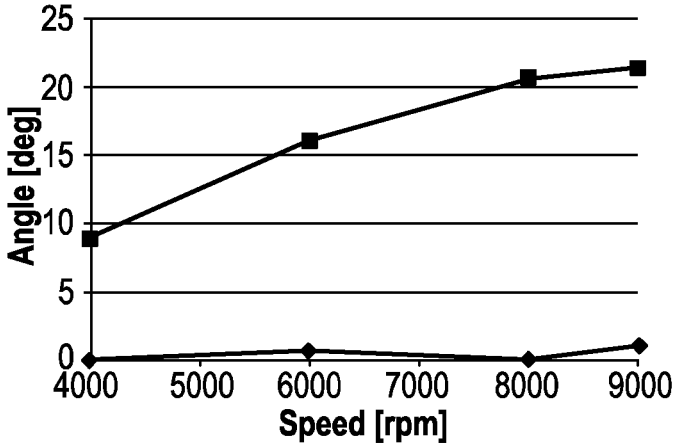
FIGS. 9B and 9C show graphs including the corresponding measurement results for different dirt particles.
Figure 9C:
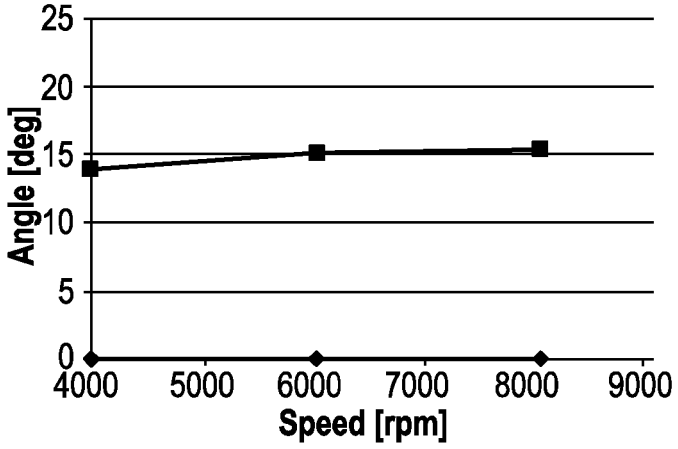
Figure 10B:
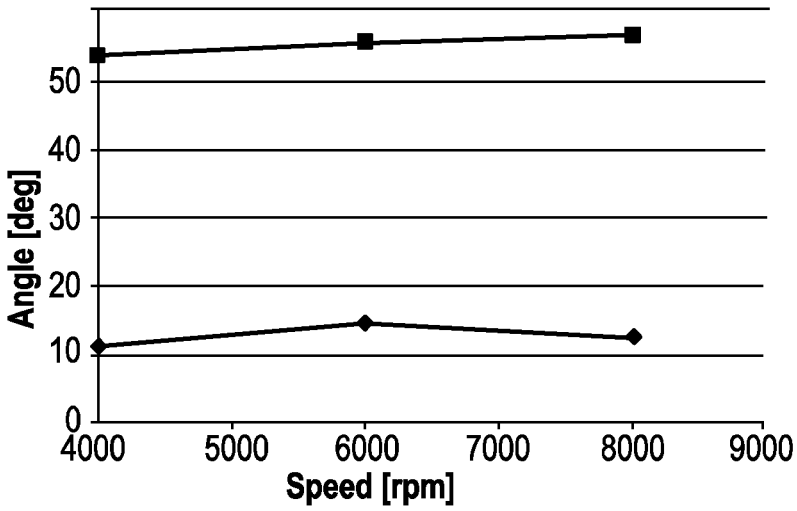
FIG. 10B shows a graph including the corresponding measurement results.

The corresponding experimental results are shown in FIGS. 9B, 9C and 10B. The graphs illustrated in these figures show the relationship of the release angle $\alpha$ in dependence on the rotational speed with which the brush 12 is driven. FIGS. 9B and 10B show this relationship for rice that has been used as test dirt, whereas FIG. 9C shows the corresponding relationship for sugar as test dirt. The upper graphs in these figures show the upper limit of the release angle $\alpha$. The lower graphs instead show the lower limit of the release angle $\alpha$.

It can be seen that the dirt particles 22 are released from the brush 12 with a release angle $\alpha$ that ranges, at least for rice, between 0-25°, when the dirt particles 22 enter the brush 12 along with the brush's rotation (see FIG. 9). On the other hand, the release angle $\alpha$ has been found to range between 10° and approximately 60°, when the dirt particles 22 enter the brush 12 against the brush's rotation (see FIG. 10). Especially in the second case shown in FIG. 10 the range for the release angle α is almost constant over the different tested rotational speed ranges of the brush 12. In other words, this means that the range for the release angle α is more or less independent of the rotational speed with which the brush 12 is driven, in case the brush 12 encounters the dirt particles 22 against the brush's rotation in the backward stroke of the nozzle 10. This independence at least applies within the range of 4,000 and 8,000 rpm that has been tested in this case.

The presented device accounts for these different situations by adjusting the position of the bouncing element 32 depending on the movement direction 40 of the nozzle 10. Therefore, the bouncing element 32 is, in a forward stroke when the dirt particles 22 enter the brush 12 along with the brush's rotation, preferably arranged at a distance d1 of zero to the surface 20. This means that it closes the suction inlet 36 in the forward stroke, so that no dirt particles 22 leave the suction area 34 again without bouncing forth and back between the bouncing surface 33 and the brush 12, and being lifted from the surface 20 in this way. Even if a dirt particle 22 is released from the brush 12 at an angle α of 0° (parallel to the surface 20), it will bounce against the bouncing surface 33 and thus be thrown back to the brush 12. The particle that is in this way thrown back to the brush 12, encounters the brush 12 against the brush's rotation, so that a similar situation occurs as this has been described for the backward stroke. The resulting release angle α will thus be larger then, so that the dirt particle 22 may be lifted in the above-described zig-zag-wise manner.

Since, on the other hand, the above-described experiments have shown that the release angle α is in a range of 10-60° when the dirt particles 22 enter the brush 12 against its rotation in the backward stroke, it has been found to be a good trade-off to arrange the bouncing element 32 in this situation with a distance d2 to the surface, wherein d2=d3*tan(α), with a having a maximum value of 20°.

The distance d3 denotes the distance between the brush 12 and the bouncing element 32. This distance is measured from the point where the tip portions 18 of the brush elements 16 lose contact from the surface 20 during the brush's rotation, since this is the point where the dirt and/or liquid particles 22, 24 are usually released from the brush 12. In the process, the brush elements 16 more or less act as a kind of whip for catching and dragging particles 22, 24, which is force-closed and capable of holding on to a particle 22, 24 on the basis of a functioning which is comparable to the functioning of a band break. The occurring accelerations at the tip portions 18 of the brush elements 16 immediately increase as soon as the brush elements 16 lose contact from the floor 20, and therefore cause the dirt particles 22 and liquid droplets 24 to be automatically released from the brush 12.

The above-mentioned maximum value for α of 20° is chosen as a trade-off value, as this has been explained in detail on page 5 to 7 in the summary of the invention. This shall be repeated only shortly in the following. Since the smallest angle α, that occurs in a backward stroke, has shown to be around 10° (see FIG. 10B), more or less all dirt particles bounce against the bouncing surface 33, if the bouncing element 32 is arranged at a distance d2=d3*tan (10°) from the surface 20. Using the above-mentioned bouncing technique this would thus result in a dust pick up ratio (dpu) of around 100%. However, the gap between the lower surface of the bouncing element 32 and the surface to be cleaned 20 should not be too small. Otherwise, larger dirt particles 22 could not enter the suction inlet 36 in the backward stroke. Thus, d2 should be in a range of 0.3 to 7 mm, preferably in a range of 0.5 to 5 mm, and most preferably in a range of 1 to 3 mm.

The above-mentioned geometrical relationship for d2 is furthermore dependent on d3. The distance d3 between the brush 12 and the bouncing element 33 should instead not be too large, since this distance d3 is limited by the kinetic energy of the dirt particles 22. In other words, the dirt particles 22 would not be able to reach the bouncing element 33, respectively being rebound to the brush 12, when the distance d3 becomes too large. Travelling from the brush 12 to the bouncing element 32, the kinetic energy of the dirt particles 22 will be lost by the air resistance of the dirt particles 22. Since there should be enough energy left to bounce back from the bouncing surface 33 into the brush 12, d3 should not exceed a value of around 3 to 4 cm.

The above-mentioned limitations for d2 and d3 can be met in a good manner, when choosing d2 to be equal or less than d3*tan(20°). If d2 is set to be exactly equal to d3*tan (20°), this has shown to result in a dpu of around 80%, which is compared to prior art devices that only make use of a combination of a brush and a vacuum source and therewith reach a dpu of 75%, still a better cleaning result. Bearing in mind that in the present case this high dpu is reached without a vacuum source (only making use of the presented bouncing technique), this is an even more surprising result. The reason why an angle of α=20° still results in a dpu of around 80% is that the dirt particles 22 are released from the brush 12 in an almost uniform distribution within the above-mentioned angle range of 10° to 60° in the backward stroke of the device 100. This means that approximately the same amount of dirt particles 22 leaves the brush 12 with an angle of 60° relative to the surface 20 as the amount that leaves the brush 12 with an angle of 10° with respect to the surface 20, or with any angle in between. Thus, a maximum angle of 20° for a results in a good trade-off, from which a fairly good dpu results, and that enables to meet the above-mentioned desired absolute distance values for d2 and d3. Of course, smaller angles for a even result in higher dpu ratios.

The adjustment means 35 for adjusting the position of the bouncing element 32 depending on the movement direction 40, may be realized in many ways. In the embodiments shown in FIGS. 1 to 4 it is realized by a guidance 35 in which the bouncing element 32 is guided and may be vertically moved upwards and downwards depending on the movement direction 40 of the device 100. This is, however, not the only possible way of adjusting the bouncing element 32.

Figure 5:
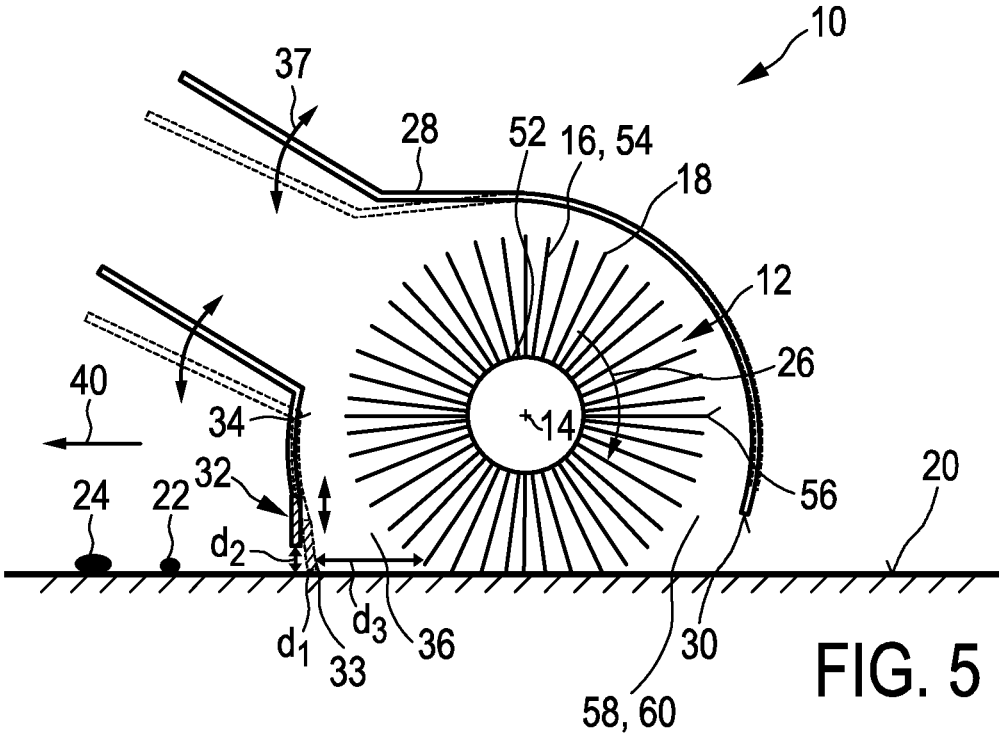
FIG. 5 shows a schematic cross-section of a third embodiment of the nozzle arrangement of the cleaning device according to the present invention, illustrating the different working positions.

As shown in FIG. 5, the adjustment means may also be realized by means to tilt the whole nozzle arrangement 10 (indicated by arrow 37) in order to adjust the position of the bouncing element 32 with respect to the surface 20. This tilting may, for example, be realized by rotating the nozzle housing 28 around a rotation axis. In order not to lift the brush 12 while rotating the nozzle housing 28, said rotation axis preferably falls together with the brush axis 14. To rotate the nozzle housing 28, wheels (not shown) can be used. The axis of at least one of the wheels may be lifted with respect to the surface 20 by any kind of mechanical mechanism. By tilting the nozzle housing 28 in this way, the position of the bouncing element 32 (the bouncer-to-surface distance d2) is automatically adapted as well (see FIG. 5). As long as the distance d2 is adapted in the above-mentioned way to guarantee the bouncing effect depending on the forward and backward stroke of the device 100, the adjustment means 35 can thus be realized in many ways. A further possibility to adjust the position d2 of the bouncing element 32 is to realize the bouncing element 32 as a kind of squeegee element (a flexible rubber lip) that glides over the surface 20 in the forward direction, and is lifted by studs that are arranged on the lower side of the rubber lip in order to force it to flip and being lifted to the above-mentioned distance d2 when the device 100 is moved in the backward direction. This has been explained above in detail on page 7 in the summary of the invention.

Figure 8:
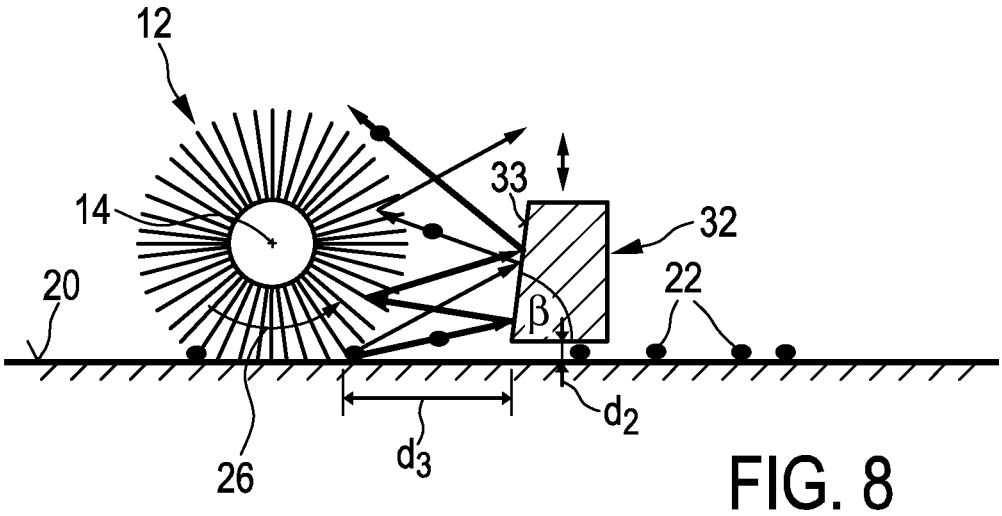
FIG. 8 illustrates the bouncing effect that is used according to the present invention to collect dirt and/or liquid, using a bouncing element according to a further embodiment.

A further improvement of the above-mentioned bouncing effect is shown in FIG. 8. According to this embodiment, the bouncing surface 33 of the bouncing element 32 is tilted with an angle β with respect to a vertical axis that is perpendicular to the surface 20. The bouncing surface 33 is thus inclined. Having this inclination, the bouncing surface 33 is no longer arranged perpendicular to the surface to be cleaned 22 (the floor) as this has been shown in the previous FIGS., but faces upwards, away from the floor 20. This allows an easier lift-up of the dirt particles 22 that bounce against the bouncing surface 33, since due to the inclination of the bouncing surface 33 the dirt particles 22 are automatically reflected in an upward direction. Especially in case the dirt particles 22 are released from the brush 12 with a release angle of 0° (parallel to the floor) the dirt particles 22 will bounce back from the bouncing surface 33 in the inclination angle β, thereby being lifted faster. This improvement has an especially beneficial effect in the forward stroke, in which the dirt particles 22 are released from the brush in a flat manner (see FIG. 9).

Figure 3:
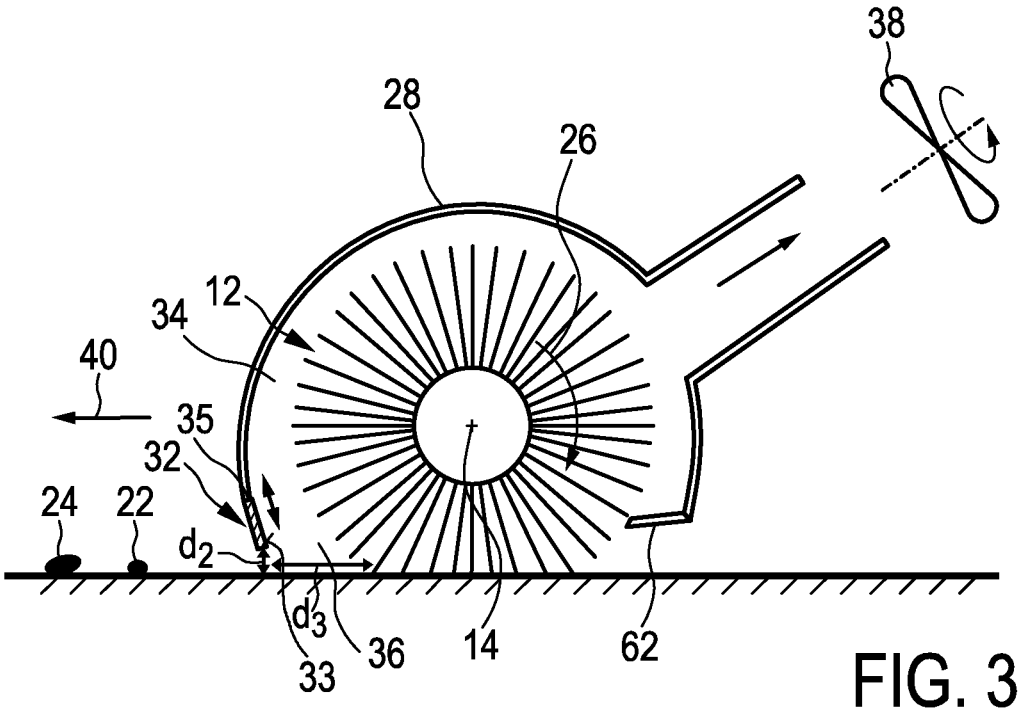
FIG. 3 shows a schematic cross-section of a second embodiment of the nozzle arrangement of the cleaning device according to the present invention, in the first working position.
Figure 4:
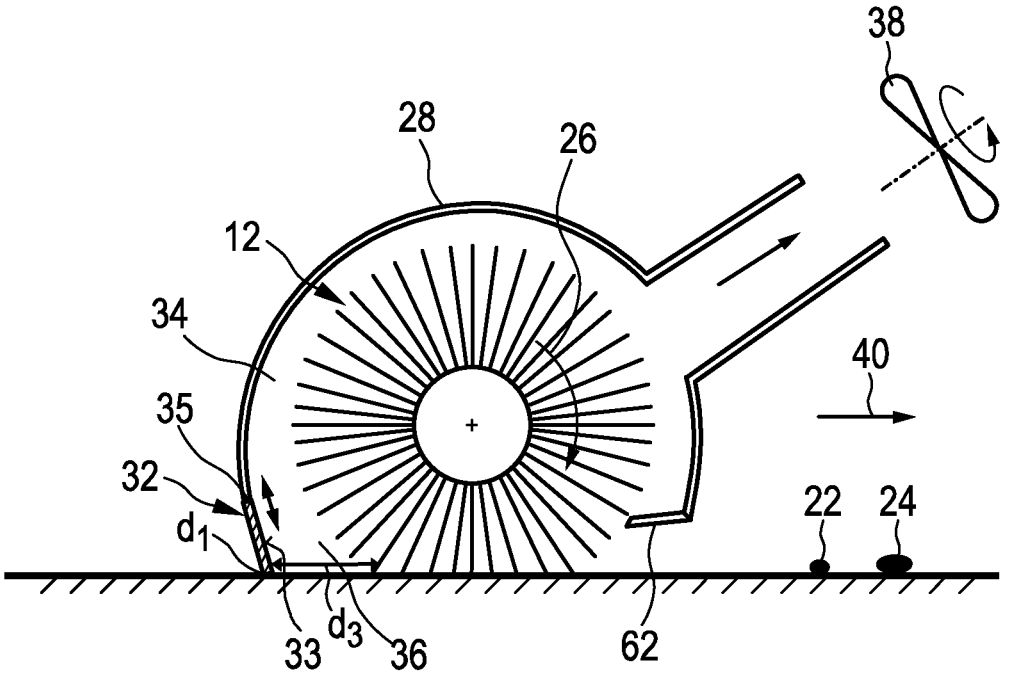
FIG. 4 shows a schematic cross-section of the second embodiment of the nozzle arrangement shown in FIG. 3 in the second working position.

As shown in FIGS. 3 and 4 illustrating the second embodiment of the present invention an additional vacuum aggregate 38 may be provided, which is in these figures only shown in a schematic way. The vacuum aggregate generates an under-pressure in the suction area 34 for ingesting dirt particles 22 and liquid 24 that have been encountered and collected by the brush 12 and the bouncing element 32. It is to be noted that said vacuum aggregate 38 is not necessarily needed. However, an additionally applied under-pressure may further improve the cleaning performance of the device 100. Especially particles 22 that are re-sprayed from the brush 12 to the surface 20 and to not bounce against the bouncing element 33 may in this case also be ingested.

The under-pressure that is generated by the vacuum aggregate 38 within the suction area 34 preferably ranges between 3 and 70 mbar, more preferably between 4 and 50 mbar, most preferably between 5 and 30 mbar. This under-pressure is, compared to regular vacuum cleaners which apply an under-pressure of around 70 mbar, quite low. However, due to the above mentioned bouncing technique, very good cleaning results may already be realized in the above-mentioned pressure ranges. Thus, also smaller vacuum aggregates 38 may be used. This increases the freedom in the selection of the vacuum pump.

FIGS. 3 and 4, which show the second embodiment of the nozzle arrangement 10, illustrate further that the positions of the bouncing element 32 and the brush 12 can be, compared to the first embodiment (shown in FIGS. 1 and 2), interchanged without leaving the scope of the present invention. The bouncing element 32 is in this case, with respect to the brush axis 14, arranged at the other side of the nozzle housing 28. In this case, the bouncing element 32 has to be arranged at the distance d2 from the floor 20, when the nozzle 10 is moved in the direction 40 as shown in FIG. 3, in which the bouncing element 32 is, seen in the direction of movement 40, located in front of the brush 12 (denoted as backward stroke). Otherwise, the liquid 24 and dirt particles 22 would again not be able to enter the suction area 34, respectively the suction inlet 36.

On the other hand, the bouncing element 32 needs to be in its closed position, respectively arranged at the distance d1 from the floor (d1 preferably being equal to zero), when the nozzle 10 is according to this embodiment moved in the so-called forward stroke as shown in FIG. 4, where the brush 12 is, seen in movement direction 40, located in front of the bouncing element 32 and encounters the dirt and liquid particles 22, 24 first. The bouncing element 32 in this case acts as a squeegee or wiper that glides over the surface 20 and collects the remaining dirt and liquid particles 22, 24 on the surface 20.

By comparing the first embodiment shown in FIGS. 1 and 2 with the second embodiment shown in FIGS. 3 and 4 it is to be noted that the rest of the arrangement, i.e. the brush 12 as well as the properties of the nozzle housing 28 remain the same. Also the direction of rotation 26 of the brush 12 remains the same, since the direction of rotation 26 of the brush 12 needs to be directed such that the brush elements 16 enter the nozzle housing 28 on the side of the nozzle housing 28 on which also the bouncing element 32 is arranged. Or in other words, the bouncing element 32 is arranged on the side of the brush 12, where the dirt and/or liquid particles 22, 24 are released from the brush 12. Otherwise, this would not enable the above-mentioned interaction of the brush 12 and the bouncing element 32.

The properties of the brush 12 may also remain the same. The cleaning result may be further improved by applying the above-mentioned parameters concerning the linear mass density of the brush elements 16 and by realizing a centrifugal acceleration at the tip portions 18 of the brush elements 16 in the above-mentioned range. Even though the bouncing technique may be realized with different kinds of brushes, properties for the brush 12 and the rotational speed with which the brush 12 is driven are presented in the following. The brush 12 preferably has a diameter which is in a range of 20 to 80 mm, and the driving means may be capable of rotating the brush 12 at an angular velocity which is at least 3,000 revolutions per minute, preferably at an angular velocity around 6,000 rpm and above. A width of the brush 12, i.e. a dimension of the brush 12 in a direction in which the rotation axis 14 of the brush 12 is extending, may be in an order of 25 cm, for example.

On an exterior surface of a core element 52 of the brush 12, tufts 54 are provided. Each tuft 54 comprises hundreds of fiber elements, which are referred to as brush elements 16. For example, the brush elements 16 are made of polyester or nylon with a diameter in an order of about 10 micrometers, and with a Dtex value which is lower than 150 g per 10 km. A packing density of the brush elements 16 may be at least 30 tufts 54 per $cm^2$ on the exterior surface of the core element 52 of the brush 12.

The brush elements 16 may be rather chaotically arranged, i.e. not at fixed mutual distances. Furthermore, it is mentioned that an exterior surface 56 of the brush elements 16 may be uneven, which enhances the capability of the brush elements 16 to catch liquid droplets 24 and dirt particles 22. In particular, the brush elements 16 may be so-called microfibers, which do not have a smooth and more or less circular circumference, but which have a rugged and more or less star-shaped circumference with notches and grooves. The brush elements 16 do not need to be identical, but preferably the linear mass density of a majority of a total number of the brush elements 16 of the brush 12 meets the requirement of being lower than 150 g per 10 km, at least at tip portions 18.

By means of the rotating brush 12, in particular by means of the brush elements 16 of the rotating brush 12, dirt particles 22 and liquid 24 are picked up from the surface 20, and are transported to a collecting position inside the cleaning device 100 in the above-described zig-zag bouncing manner between the brush 12 and the bouncing surface 33. The occurring accelerations at the tip portions 18 of the brush elements 16 cause the dirt particles 22 and liquid droplets 24 to be automatically released from the brush 12, when the brush elements 16 lose contact from the floor 20 during their rotation. Most of the particles then bounce against the bouncing surface 33 of the bouncing element 32. Since not perfectly all dirt particles 22 and liquid droplets 24 hit the bouncing surface 33 and are lifted in the above-mentioned manner or may be directly ingested by the vacuum aggregate 38 (in case an additional vacuum aggregate 38 is provided), a small amount of dirt and liquid will be flung back onto the surface 20 in the area where the brush elements 16 lose the contact from the surface 20. However, this effect of re-spraying the surface 20 is overcome by the bouncing element 32 which collects this re-sprayed liquid and dirt by acting as kind of wiper in the forward stroke, so that the remaining liquid 24 and dirt 22 may then be ingested due to the applied under-pressure. The liquid 24 and dirt 22 does therefore not leave the suction area 34 again without bouncing upwards or being ingested.

Due to the chosen technical parameters the brush elements 16 have a gentle scrubbing effect on the surface 20, which contributes to counteracting adhesion of liquid 24 and dirt particles 22 to the surface 20.

As the brush 12 rotates, the movement of the brush elements 16 over the surface 20 continues until a moment occurs at which contact is eventually lost. When there is no longer a situation of contact, the brush elements 16 are urged to assume an original, outstretched condition under the influence of centrifugal forces which are acting on the brush elements 16 as a result of the rotation of the brush 12. As the brush elements 16 are bent at the time that there is an urge to assume the outstretched condition again, an additional, outstretching acceleration is present at the tip portions 18 of the brush elements 16, wherein the brush elements 16 swish from the bent condition to the outstretched condition, wherein the movement of the brush elements 16 is comparable to a whip which is swished. The acceleration at the tip portions 18 at the time the brush elements 16 have almost assumed the outstretched condition preferably meets a requirement of being at least 3,000 m/sec$^2$.

Under the influence of the forces acting at the tip portions 18 of the brush elements 16 during the movement as described, the quantities of dirt particles 22 and liquid 24 are expelled from the brush elements 16, as these forces are considerably higher than the adhesion forces. Hence, the liquid 24 and the dirt particles 22 are forced to fly away in the direction towards the bouncing element 32.

Under the influence of the acceleration, the liquid 24 may be expelled in small droplets. This is advantageous for further separation processes such as performed by the vacuum fan aggregate 38, in particular the centrifugal fan of the vacuum aggregate 38, which serves as a rotatable air-dirt separator. It is noted that suction forces such as the forces exerted by the centrifugal fan do not play a role in the above-described process of picking up liquid and dirt by means of brush elements 16. However, these suction forces may be used for picking up the dirt and liquid that has not been lifted by the presented bouncing technique.

Besides the functioning of each of the brush elements 16, as described in the foregoing, another effect which contributes to the process of picking up dirt particles 22 and liquid 24 may occur, namely a capillary effect between the brush elements 16. In this respect, the brush 12 with the brush elements 16 is comparable to a brush 12 which is dipped in a quantity of paint, wherein paint is absorbed by the brush 12 on the basis of capillary forces.

It appears from the foregoing that the brush 12 according to the present invention preferably has the following properties:

- the soft tufts 54 with the flexible brush elements 16 will be stretched out by centrifugal forces during the contact-free part of a revolution of the brush 12;
- it is possible to have a perfect fit between the brush 12 and the surface 20 to be cleaned, since the soft tufts 54 will bend whenever they touch the surface 20, and straighten out whenever possible under the influence of centrifugal forces;
- the brush 12 constantly cleans itself, due to sufficiently high acceleration forces, which ensures a constant cleaning result;
- heat generation between the surface 20 and the brush 12 is minimal, because of a very low bending stiffness of the tufts 54;
- a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and
- dirt 22 is removed from the surface 20 in a gentle yet effective way, by means of the tufts 54, wherein a most efficient use of energy can be realized on the basis of the low stiffness of the brush elements 16.

On the basis of the relatively low value of the linear mass density, it may be so that the brush elements 16 have very low bending stiffness, and, when packed in tufts 54, are not capable of remaining in their original shape. In conventional brushes, the brush elements spring back once released. However, the brush elements 16 having the very low bending stiffness as mentioned will not do that, since the elastic forces are so small that they cannot exceed internal friction forces which are present between the individual brush elements 16. Hence, the tufts 54 will remain crushed after deformation, and will only stretch out when the brush 12 is rotating.

In comparison with conventional devices comprising hard brushes for contacting a surface to be cleaned, the brush 12 which is preferably used according to an embodiment of the present invention is capable of realizing cleaning results which are significantly better, due to the working principle according to which brush elements 16 are used for picking up liquid 24 and dirt 22 and taking the liquid 24 and the dirt 22 away from the surface 20 to be cleaned, wherein the liquid 24 and the dirt 22 are flung away by the brush elements 16 before they contact the surface 20 again in a next round.

As a result of the fact that the brush 12 is indented by the surface 20 to be cleaned, the brush 12 acts as a kind of gear pump which pumps air from the inside of the nozzle housing 28 to the outside. This is an effect which is disadvantageous, as dirt particles 22 are blown away and droplets of liquid 24 are formed at positions where they are out of reach from the brush 12 and can fall down at unexpected moments during a cleaning process.

In order to compensate for the pumping effect as mentioned, it is proposed to have means for generating an airflow in an area where the brush 12 contacts the surface 20, which airflow is used to compensate for the airflow generated by the brush 12.

These means can be realized in various ways. A first implementation possibility is shown in the first embodiment which is shown in FIGS. 1 and 2, where a small opening 58 is arranged between nozzle housing 28 and the brush 12 at a position where the brush elements 16 leave the nozzle housing 28 during the rotation of the brush 12. This opening 58 realizes a further suction inlet 60 to the suction area 34 which applies an under-pressure in the area where the brush elements 16 first contact the surface 20. This under-pressure generates an airflow that counteracts the unwanted turbulent airstream that is generated in front of the brush 12 due to its rotation during use.

A second possibility to counteract the unwanted turbulent airstream in front of the brush 12, is to equip the brush 12 with tufts 54 of brush elements 16 which are arranged in rows on the brush 12, so that the necessary suction power will be significantly reduced.

Furthermore, it is possible to use a deflector 62 for indenting the brush 12 at a position, seen in rotation direction 26, before the brush 12 contacts the surface 20, as this is exemplary shown in second embodiment which is shown in FIGS. 3 and 4. The deflector 62 has the function to press the brush elements 16 together by deflecting them. In this way air, which is present in the space between the brush elements 16, is pushed out of said space. When the brush elements 16 are, after leaving the deflector 62, moved apart from each other again, the space in between the brush elements 16 increases so that air will be sucked into the brush 12, wherein an under-pressure is created that sucks in dirt 22 and liquid particles 24. This again compensates for the air blow that is generated by the rotating brush 12. Examples of deflectors as mentioned are found in PCT/IB2009/054333 and PCT/IB2009/054334, both in the name of Applicant.

The airflow which needs to be compensated can be calculated, using the following equation:

$$\Phi_c=\pi*f*W*F*(D*I-I^2)$$

in which:

$\Phi_c$=airflow which needs to be compensated for ($m^3/s$)

f=brush frequency (Hz)

W=width of the brush 12 (m)

F=brush compensation factor (–)

D=diameter of the brush 12 (m)

I=indentation of the brush 12 by the surface 20 (m)

In a practical example, f=133 Hz, W=0.25 m, D=0.044 m, and I=0.003 m. In respect of the brush compensation factor, it is noted that this factor is determined on the basis of experiments with a brush having features as mentioned above, and is found to be 0.4. With the values as mentioned, the following compensation flow is found:

$$\Phi_c=\pi*133*0.25*0.4*(0.044*0.003-0.003^2)$$
$$=0.005015\ m^3/s$$

Hence, in this example, it is advantageous to have a compensating airflow of about 5 liters per second. Such an airflow can very well be realized in practice with one of the implementation possibilities exemplarily mentioned above, so that the disadvantageous pumping effect of the brush 12 can actually be dispensed with.

Figure 11:
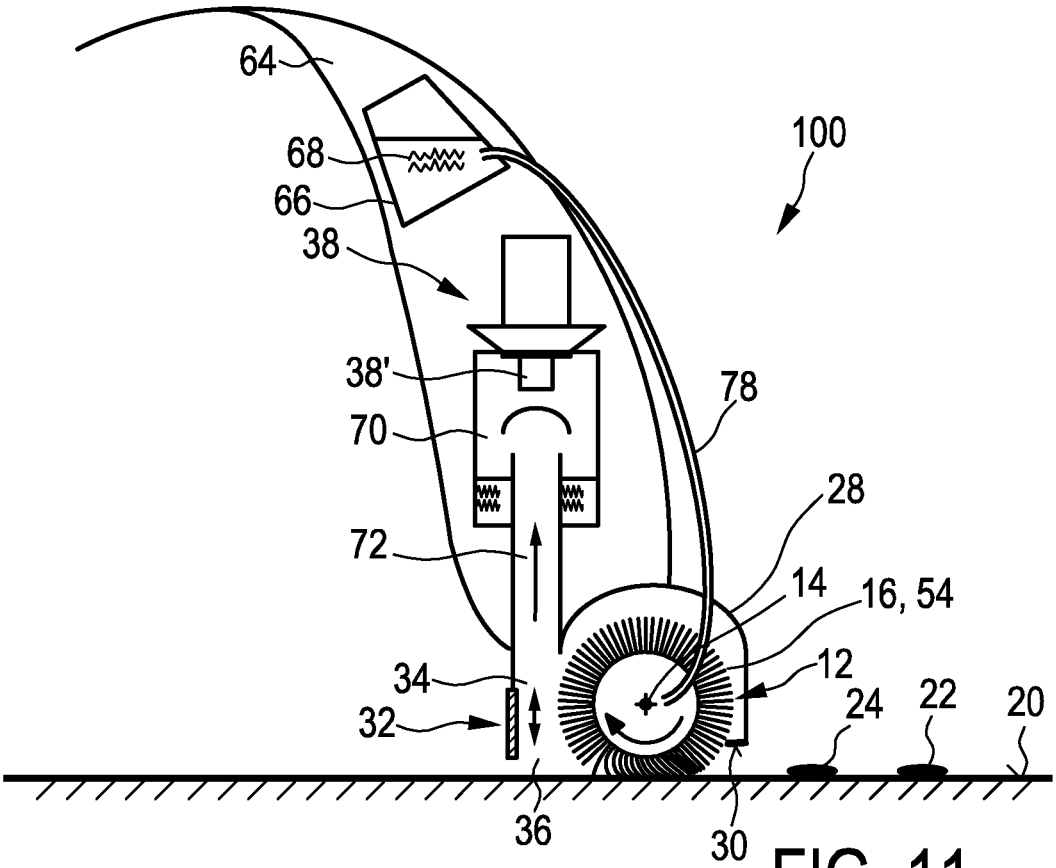
FIG. 11 shows a schematic cross-section of the cleaning device according to the present invention in its entirety.

FIG. 11 provides a view of the cleaning device 100 according to the present invention in its entirety. According to this schematic arrangement the cleaning device 100 comprises a nozzle housing 28 in which the brush 12 is rotatably mounted on the brush axis 14. A drive means, which can be realized be a regular motor, such as e.g. an electro motor (not shown), is preferably connected to or even located on the brush axis 14 for the purpose of driving the brush 12 in rotation. It is noted that the motor may also be located at any other suitable position within the cleaning device 100.

In the nozzle housing 28, means such as wheels (not shown) are arranged for keeping the rotation axis 14 of the brush 12 at a predetermined distance from the surface 20 to be cleaned, wherein the distance is chosen such that the brush 12 is indented. Preferably, the range of the indentation is from 2% to 12% of a diameter of the brush 12 relating to a fully outstretched condition of the brush elements 16. Hence, when the diameter is in an order of 50 mm, the range of the indentation can be from 1 to 6 mm. These adjusting these wheels may also tilt the nozzle 10 depending on the movement direction 40 to adjust the position of the bouncing element 32 as this has been explained above with reference to FIG. 5.

Besides the nozzle housing 28, the brush 12 and the bouncing element 32, the cleaning device 100 is preferably provided with the following components:

- a handle 64 which allows for easy manipulation of the cleaning device 100 by a user;
- a reservoir 66 for containing a cleansing liquid 68 such as water;
- a debris collecting container 70 (also denoted as dust pan) for receiving liquid 24 and dirt particles 22 picked up from the surface 20 to be cleaned;
- a flow channel in the form of, for example, a hollow tube 72, connecting the debris collecting container 70 to the suction area 34, which suction area 34 constitutes the suction inlet 36 on the bottom side 30 of the nozzle 10. It has to be noted that, in the meaning of the present invention the flow channel including the hollow tube 72 may also be denoted as suction area 34 in which the above mentioned under-pressure may be applied in case the additional vacuum aggregate 38 is provided (not mandatory); and
- the vacuum fan aggregate 38 (not mandatory) comprising a centrifugal fan 38', arranged at a side of the debris collecting chamber 70 which is opposite to the side where the tube 72 is arranged.

For sake of completeness, it is noted that within the scope of the present invention, other and/or additional constructional details are possible. For example, an element may be provided for deflecting the debris 22, 24 that is flung upwards, so that the debris 22, 24 first undergoes a deflection before it eventually reaches the debris collecting chamber 70. Also, the optional vacuum fan aggregate 38 may be arranged at another side of the debris collecting chamber 70 than the side which is opposite to the side where the tube 72 is arranged.

Figure 12:
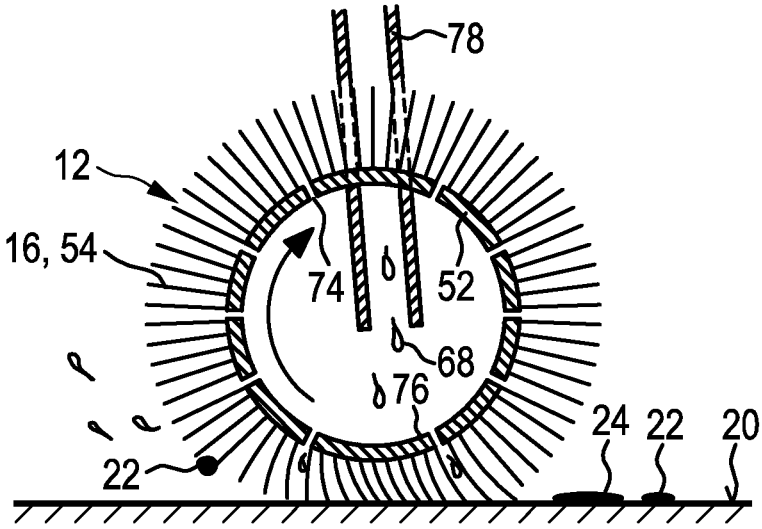
FIG. 12 shows a schematic cross-section of an embodiment of a brush of the cleaning device.

According to an embodiment, which is shown in FIG. 12, the brush 12 comprises a core element 52. This core element 52 is in the form of a hollow tube provided with a number of channels 74 extending through a wall 76 of the core element 52. For the purpose of transporting cleansing fluid 68 from the reservoir 66 to the inside of the hollow core element 52 of the brush 12, e.g. a flexible tube 78 may be provided that leads into the inside of the core element 52.

According to this embodiment cleansing fluid 68 may be supplied to the hollow core element 52, wherein, during the rotation of the brush 12, the liquid 68 leaves the hollow core element 52 via the channels 74, and wets the brush elements 16. In this way the liquid 68 also drizzles or falls on the surface 20 to be cleaned. Thus, the surface 20 to be cleaned becomes wet with the cleansing liquid 68. This especially enhances the adherence of the dirt particles 22 to the brush elements 16 and, therefore improves the ability to remove stains from the surface 20 to be cleaned.

According to the present invention, the rate at which the liquid 68 is supplied to the hollow core element 52 can be quite low, wherein a maximum rate can be 6 ml per minute per cm of the width of the brush 12, for example.

However, it is to be noted that the feature of actively supplying water 68 to the surface 20 to be cleaned using hollow channels 74 within the brush 12 is not a necessary, but an optional feature. Alternatively, a cleansing liquid could be supplied by spraying the brush 12 from outside or by simply immersing the brush 12 in cleansing water before the use. Instead of using an intentionally chosen liquid, it is also possible to use a liquid that has been already spilled, i.e. a liquid that needs to be removed from the surface 20 to be cleaned.

The pick-up of the cleansing water 68 from the floor is, as already mentioned above, either done by the bouncing element 32 when being positioned at a distance d1 to the surface 20, collecting the water by acting as a kind of wiper transporting liquid to the suction area 34 where may be ingested due to the under-pressure generated by the optional vacuum aggregate 38, or the water is directly picked up from the floor by the interaction of the brush 12 and the bouncing element 33. In comparison with conventional devices comprising hard brushes that are not able to pick-up water, the brush 12 that may be used according to the present invention is capable of picking-up water. The realized cleaning results are thus significantly better.

The technical parameters regarding the brush 12, the brush elements 16 and the drive means result from experiments which have been performed in the context of the present invention.

In the following, one of the experiments and the results of the experiment will be described. The tested brushes were equipped with different types of fiber materials used for the brush elements 16, including relatively thick fibers and relatively thin fibers. Furthermore, the packing density as well as the Dtex values have been varied. The particulars of the various brushes are given in the following table.

| | packing density (# tufts/ $cm^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | polyester | 11 | very soft, twined |

The experiment includes rotating the brush under similar conditions and assessing cleaning results, wear, and power to the surface 20 subjected to treatment with the brush 12. This provides an indication of heat generation on the surface 20. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 16 with a linear mass density in a range of 100 to 150 g per 10 km, and to obtain useful cleaning results, although it appears that the water pick-up, the wear behavior and the power consumption are not so good. It is concluded that an appropriate limit value for the linear mass density is 150 g per 10 km. However, it is clear that with a much lower linear mass density, the cleaning results and all other results are very good. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 20 are sufficiently low.

It is noted that the optional minimum value of 3,000 $m/sec^2$ in respect of the acceleration which is prevailing at tips 18 of the brush elements 16 during some time per revolution of the brush 12, in particular some time during a dirt release period, in which there is no contact between the brush elements 16 and the surface 20, is supported by results of experiments which have been performed in the context of the present invention.

In the following, one of the experiments and the results of the experiment will be described. The following conditions are applicable to the experiment:

1) A brush 12 having a diameter of 46 mm, a width of approximately 12 cm, and polyester brush elements 16 with a linear mass density of about 0.8 g per 10 km, arranged in tufts 54 of about 800 brush elements 16, with approximately 50 tufts 54 per $cm^2$, is mounted on a motor shaft.

2) The weight of the assembly of the brush 12 and the motor is determined.

3) The power supply of the motor is connected to a timer for stopping the motor after a period of operation of 1 second or a period of operation of 4 seconds.

4) The brush 12 is immersed in water, so that the brush 12 is completely saturated with the water. It is noted that the brush 12 which is used appears to be capable of absorbing a total weight of water of approximately 70 g.

5) The brush 12 is rotated at an angular velocity of 1,950 revolutions per minute, and is stopped after 1 second or 4 seconds.

6) The weight of the assembly of the brush 12 and the motor is determined, and the difference with respect to the dry weight, which is determined under step 2), is calculated.

7) Steps 4) to 6) are repeated for other values of the angular velocity, in particular the values as indicated in the following table, which further contains values of the weight of the water still present in the brush 12 at the stops after 1 second and 4 seconds, and values of the associated centrifugal acceleration, which can be calculated according to the following equation:

$$a=(2*\pi*f)^2*R$$

in which:

a=centrifugal acceleration ($m/s^2$)

f=brush frequency (Hz)

R=radius of the brush 12 (m)

| angular velocity (rpm) | weight of water present after 1 s (g) | weight of water present after 4 s (g) | centrifugal acceleration ($m/s^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 13:
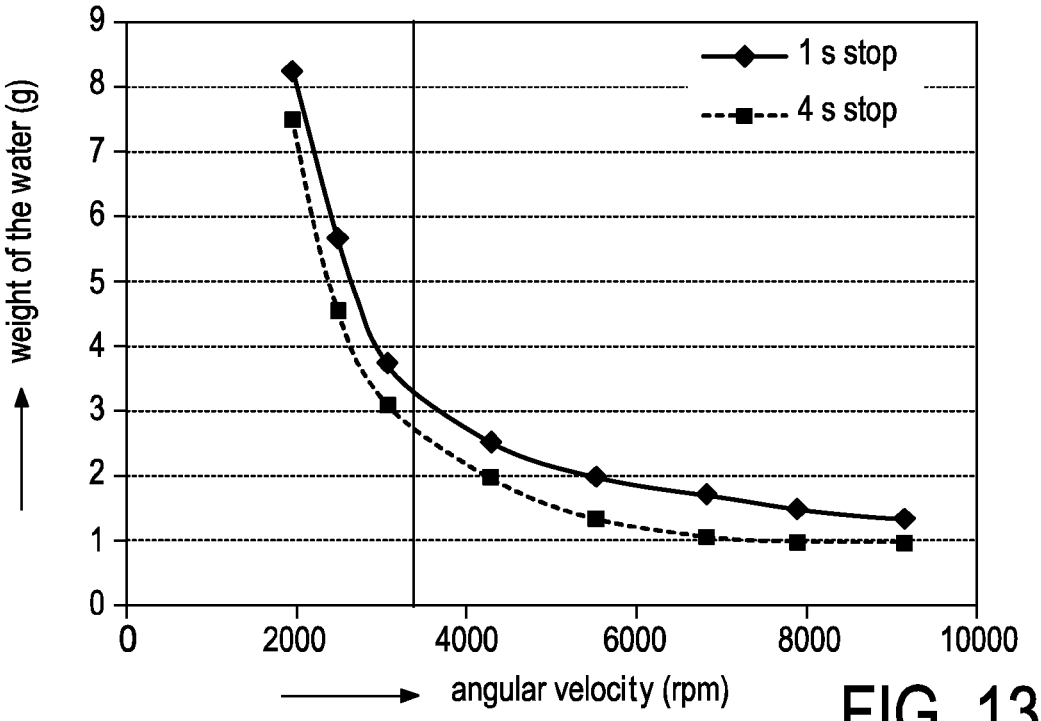
FIG. 13 shows a graph which serves for illustrating a relation between an angular velocity of a brush and a self-cleaning capacity of said brush.
Figure 14:
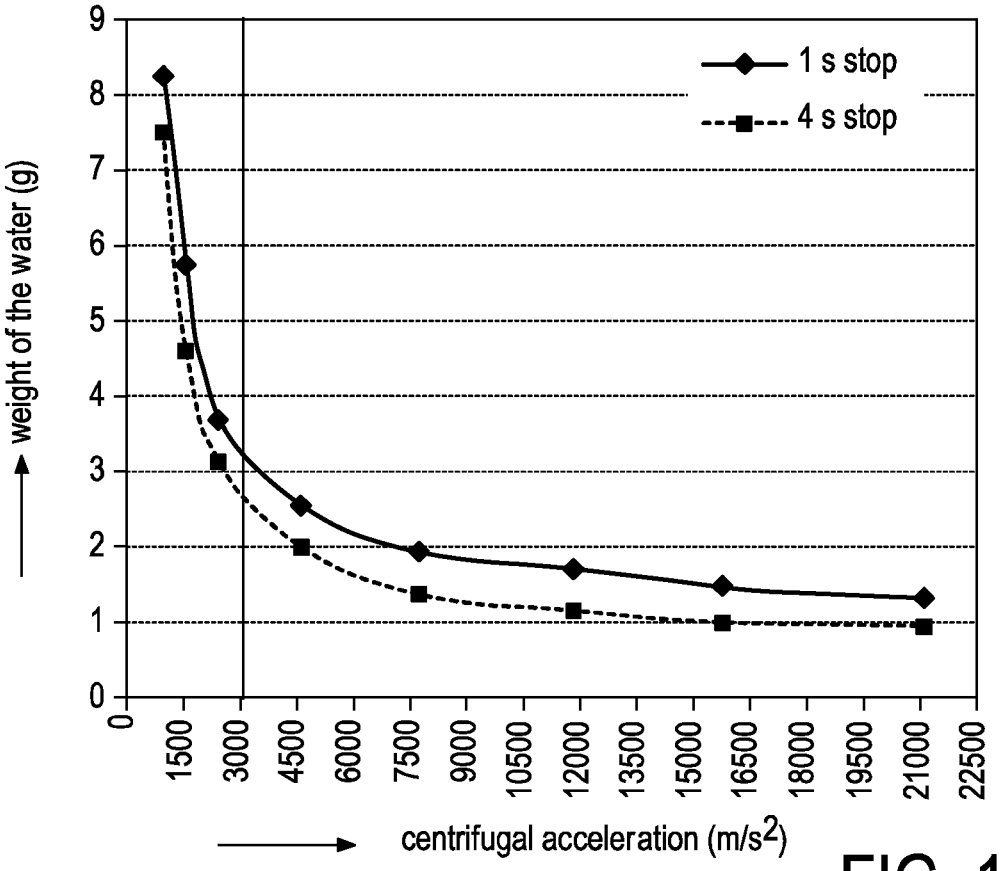
FIG. 14 shows a graph which serves for illustrating a relation between a centrifugal acceleration of a brush and a self-cleaning capacity of said brush.

The relation which is found between the angular velocity and the weight of the water for the two different stops is depicted in the graph of FIG. 13, and the relation which is found between the centrifugal acceleration and the weight of the water for the two different stops is depicted in the graph of FIG. 14, wherein the weight of the water is indicated at the vertical axis of each of the graphs. It appears from the graph of FIG. 13 that the release of water by the brush 12 strongly decreases, when the angular velocity is lower than about 4,000 rpm. Also, it seems to be rather stable at angular velocities which are higher than 6,000 rpm to 7,000 rpm.

A transition in the release of water by the brush 12 can be found at an angular velocity of 3,500 rpm, which corresponds to a centrifugal acceleration of 3,090 $m/s^2$. For sake of illustration of this fact, the graphs of FIGS. 13 and 14 contain a vertical line indicating the values of 3,500 rpm and 3,090 $m/s^2$, respectively.

On the basis of the results of the experiment as explained in the foregoing, it may be concluded that a value of 3,000 $m/s^2$ in respect of an acceleration at tips 18 of the brush elements 16 during a contact-free period is a realistic minimum value as far as the self-cleaning capacity of brush elements 16 which meet the optional requirement of having a linear mass density which is lower than 150 g per 10 km, at least at tip portions 18, is concerned. A proper performance of the self-cleaning function is important for obtaining good cleaning results, as has already been explained in the foregoing.

For sake of completeness, it is noted that in the cleaning device 100 according to the present invention, the centrifugal acceleration may also be lower than 3,000 $m/s^2$. The reason is that the acceleration which occurs at tips 18 of the brush elements 16 when the brush elements 16 are straightened out can be expected to be higher than the normal centrifugal acceleration. The experiment shows that a minimum value of 3,000 $m/s^2$ is valid in respect of an acceleration, which is the normal, centrifugal acceleration in the case of the experiment, and which can be the higher acceleration which is caused by the specific behavior of the brush elements 16 when the dirt pick-up period has passed and there is room for straightening out in an actual cleaning device 100 according to the present invention, which leaves a possibility for the normal, centrifugal acceleration during the other periods of the rotation (e.g. the dirt pick-up period) to be lower.

Even though a single brush is, according to the present invention, preferred, it is clear that also further brushes may be used without leaving the scope of the present invention. Further, it is to be noted that the above-mentioned brush parameters are only optional parameters that may be used to further increase the cleaning effect. However, the above-mentioned bouncing effect also occurs when using other kinds of brushes.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For sake of clarity, it is noted that a fully outstretched condition of the brush elements 16 is a condition in which the brush elements 16 are fully extending in a radial direction with respect to a rotation axis 14 of the brush 12, wherein there is no bent tip portion in the brush elements 16. This condition can be realized when the brush 12 is rotating at a normal operative speed, which may be a speed at which an acceleration of 3,000 $m/sec^2$ at the tips 18 of the brush elements 16 can be realized. It is possible for only a portion of the brush elements 16 of a brush 12 to be in the fully outstretched condition, while another portion is not, due to obstructions which are encountered by the brush elements 16. Normally, the diameter D of the brush 12 is determined with all of the brush elements 16 in the fully outstretched condition.

The tip portions 18 of the brush elements 16 are outer portions of the brush elements 16 as seen in the radial direction, i.e. portions which are the most remote from the rotation axis 14. In particular, the tip portions 18 are the portions which are used for picking up dirt particles 22 and liquid, and which are made to slide along the surface 20 to be cleaned. In case the brush 12 is indented with respect to the surface 20, a length of the tip portion is approximately the same as the indentation.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A cleaning device for cleaning a surface, comprising:

a motor;

a nozzle arrangement comprising:

a brush compartment extending from a first edge of said nozzle arrangement, said brush compartment partially surrounding a brush therein, wherein said brush is rotatable about a brush axis, said brush being provided with a plurality of brush elements, each of said plurality of brush elements having a tip portion, and wherein selected ones of said tip portions contact the surface to be cleaned during rotation of the brush, and wherein the motor is configured to drive the brush in rotation;

a bouncing element extending from a second edge of said nozzle arrangement, said bouncing element spaced apart from said brush compartment and extending substantially parallel to the brush axis, said bouncing element comprising:

a plurality of studs positioned along a surface of the bouncing element facing away from the brush, wherein said plurality of studs:

are positioned away from said surface when the cleaning device is moved in a forward direction, and wherein the bouncing element is seen in a direction of movement of the cleaning device, located behind the brush; and contact the surface when the cleaning device is moved in a backward direction opposite said forward direction, wherein said bouncing element is raised above the surface by a distance d2 by said plurality of studs, wherein the distance d2 is set equal to d3*tan(A), and wherein A is set at a non-zero angle no greater than 20° and d3 is a distance measured parallel to the surface from a point on the surface where said selected ones of said plurality of tip portions of the plurality of brush elements initially lose contact with the surface during rotation of the brush to a point on the bounce element; and a vacuum aggregate port positioned between the brush compartment and the bouncing element, said vacuum aggregate configured to:

generate an under-pressure in an area between the brush compartment and the bouncing element.

2. The cleaning device as claimed in claim 1, wherein A is equal to or smaller than 15°.

3. The cleaning device as claimed in claim 1, wherein the distance d2 is in a range of 0.3 to 7 mm.

4. The cleaning device as claimed in claim 1, wherein the surface of the bouncing element facing said brush is tilted with respect to an axis perpendicular to the surface.

5. The cleaning device as claimed in claim 1, wherein a linear mass density of the plurality of the brush elements is, at least at the tip portions, lower than 150 g per 10 km.

6. The cleaning device as claimed in claim 1, wherein the motor is configured to:

realize a centrifugal acceleration at the tip portions of the plurality of brush elements free from contact to the surface during rotation of the brush, of at least 3,000 $m/s^2$.

7. The cleaning device as claimed in claim 1, wherein the motor is configured to:

realize an angular velocity of the brush in a range of 3,000 to 15,000 revolutions per minute.

8. The cleaning device as claimed in claim 1, wherein the brush has a diameter in a range of 10 to 100 mm and a length of the plurality of brush elements is in a range of 1 to 20 mm when the plurality of brush elements are in a fully outstretched condition.

9. The cleaning device as claimed in claim 1, wherein said under-pressure is in a range of 3 to 70 mbar.

10. The cleaning device as claimed in claim 1, wherein a packing density of the plurality of brush elements is at least 30 tufts of brush elements per $cm^2$, and wherein a number of brush elements per tuft is at least 500.

11. The cleaning device as claimed in claim 1, comprising a tube configured to:

supply a liquid to an inner section of the brush at a rate that is lower than 6 ml per minute per cm of a width of the brush in which the brush axis is extending.

12. A nozzle arrangement for a cleaning device, said nozzle arrangement comprising:

a brush compartment extending from a first edge of said nozzle arrangement, said brush compartment partially surrounding a brush contained therein, said brush being rotatable about a brush axis, said brush comprising:

brush elements having tip portions for contacting a surface to be cleaned during rotation of the brush, a bouncing element extending from a second edge of the nozzle arrangement, said bouncing element comprising a bouncing surface facing said brush, wherein the bouncing surface is tilted with respect to the surface, said bouncing element being spaced apart from the brush and extending substantially parallel to the brush axis, said bouncing element comprising:

a plurality of studs arranged along a surface of the bouncing element facing away from the brush, said plurality of studs being sized to raise said bouncing element by a distance d2, wherein said bouncing element is in contact with said surface when the cleaning device is moved in a forward direction, wherein the bouncing element is seen in a direction of movement of the cleaning device, located behind the brush, and raised off the surface by said distance d2 by said plurality of studs contacting said surface when the cleaning device is moved in a backward direction, wherein said distance d2 is determined as d3*tan (A), and wherein d3 is a distance parallel to the surface between the bouncing element and a point on the surface where said tip portions of the brush elements lose contact with the surface during rotation of the brush and wherein A is selected as a non-zero angle no greater than 20°; and a vacuum port positioned between the brush compartment and the bouncing element.

13. The nozzle arrangement of claim 12, further comprising:

a motor configured to drive the brush in rotation.

14. The nozzle arrangement of claim 12, wherein said vacuum port is configured to draw air from said nozzle arrangement.

15. The nozzle arrangement of claim 12, further comprising:

a fluid injection port configured to:

allow entry of a fluid into said brush compartment.

16. The cleaning apparatus of claim 12, wherein said vacuum port is configured to:

draw air from said nozzle arrangement.

17. The cleaning apparatus of claim 12, further comprising:

a port configured to allow entry of a fluid into said brush compartment.

18. A cleaning apparatus comprising:

a motor, a nozzle element, said nozzle element comprising:

a brush compartment extending from a first edge of said nozzle element a bouncing element extending from a second edge of said nozzle element, wherein an area is formed between said brush compartment and said bouncing element; and a vacuum port in fluid communications with said area, wherein said brush compartment comprises:

a brush, said brush configured to:

rotate about a brush axis, said brush axis substantially parallel to a forward edge and a rear edge of said nozzle element, said brush comprising a plurality of brush elements, each of said plurality of brush elements having a tip portion configured to contact a surface to be cleaned during rotation of the brush, wherein the motor is configured to rotate the brush, and wherein said nozzle element is rotatable about said brush axis to raise said bouncing element above said surface by a distance d2 when said cleaning apparatus is moved in said forward direction, and wherein said distance d2 is determined as d3*tan(A), and wherein d3 is a distance parallel to the surface between the bouncing element and a point on the surface, and wherein said tip portions of said brush elements lose contact with the surface during rotation of the brush, and wherein A is a non-zero angle no greater than 20°.

* * * * *